US009844309B2

(12) United States Patent
Plato et al.

(10) Patent No.: US 9,844,309 B2
(45) **Date of Patent: *Dec. 19, 2017**

(54) VACUUM

(71) Applicant: Black & Decker Inc., New Britain, CT (US)

(72) Inventors: Barry E. Plato, Bel Air, MD (US); Jonathan Bianco, Parkton, MD (US); Abraham Sanchez, Towson, MD (US); Michael Cieszko, Baltimore, MD (US); Daryl S. Meredith, York, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/223,895

(22) Filed: Jul. 29, 2016

(65) Prior Publication Data

US 2016/0331198 A1 Nov. 17, 2016

Related U.S. Application Data

(63) Continuation of application No. 14/310,763, filed on Jun. 20, 2014, now Pat. No. 9,408,509, which is a (Continued)

(51) Int. Cl.

| | |
|---|---|
| ***A47L 5/36*** | (2006.01) |
| ***A47L 9/20*** | (2006.01) |
| ***A47L 7/00*** | (2006.01) |
| ***A47L 9/10*** | (2006.01) |
| ***A47L 9/30*** | (2006.01) |

(Continued)

(52) U.S. Cl.

CPC ..... *A47L 9/20* (2013.01); *A47L 5/362* (2013.01); *A47L 5/365* (2013.01); *A47L 7/0004* (2013.01); *A47L 7/0019* (2013.01); *A47L 7/0028* (2013.01); *A47L 9/009* (2013.01); *A47L 9/0036* (2013.01);

(Continued)

(58) Field of Classification Search

CPC . A47L 9/20; A47L 9/1691; A47L 5/28; A47L 9/1666; A47L 9/1683; A47L 7/0038; A47L 7/0028; A47L 7/0042; A47L 5/365; A47L 7/004; A47L 9/0072; A47L 9/106; A47L 5/36; A47L 7/00; A47L 9/00; A47L 9/10

USPC ... 15/352, 353, 347, 337, 319, 327.1, 327.6; 55/372, 374

See application file for complete search history.

(56) References Cited

U.S. PATENT DOCUMENTS 2,221,746 A * 11/1940 Kirby ..... A47L 5/30 15/324
2,322,223 A * 6/1943 Coss ..... A47L 5/32 15/324

(Continued)

FOREIGN PATENT DOCUMENTS

DE 202011002455 * 5/2011

*Primary Examiner* — David Redding
(74) *Attorney, Agent, or Firm* — Kofi A. Schulterbrandt; Scott B. Markow

(57) ABSTRACT

The present invention is directed to a vacuum including a dust extraction system. The system includes a filter assembly, an airflow generation assembly, and valve assembly. The airflow generation assembly is configured to draw contaminated air toward the filter assembly and exhaust filtered air as a discharge stream. The filter assembly is configured to remove contaminants from the contaminated airflow by capturing particulate material suspended within the airflow. The valve assembly is configured to selectively direct filtered airflow into the filter assembly such that the filtered air stream cleans the filter.

7 Claims, 43 Drawing Sheets

Related U.S. Application Data continuation-in-part of application No. 13/431,302, filed on Mar. 27, 2012, now Pat. No. 9,271,620.

(51) Int. Cl.
*A47L 9/00* (2006.01)
*A47L 9/24* (2006.01)

(52) U.S. Cl.
CPC ..... *A47L 9/0072* (2013.01); *A47L 9/106* (2013.01); *A47L 9/24* (2013.01); *A47L 9/30* (2013.01)

(56) References Cited

U.S. PATENT DOCUMENTS

| | | | | |
|---|---|---|---|---|
| 6,170,118 | B1 * | 1/2001 | McIntyre | A47L 5/365 15/323 |
| 6,336,244 | B1 * | 1/2002 | Tarutani | A47L 5/14 15/326 |
| 8,376,376 | B2 * | 2/2013 | Thibault | A47L 13/58 280/79.11 |
| 9,408,509 | B2 * | 8/2016 | Plato | A47L 9/0072 |
| 2004/0231090 | A1 * | 11/2004 | Kushida | A47L 5/22 15/326 |

* cited by examiner

VACUUM

RELATED APPLICATIONS

The present application is a continuation of U.S. Continuation In Part application Ser. No. 14/310,763, filed on Jun. 20, 2014 and U.S. application Ser. No. 13/431,302 now Granted U.S. Pat. No. 9,271,620 on Mar. 1, 2016 entitled "VACUUM", the contents of which is incorporated herein by reference in its entirety.

FIELD OF THE INVENTION

The present invention is directed toward a construction site or tool shop vacuum and, in particular, to a vacuum including a filter system and an airflow arrangement that periodically cleans the filter system during operation.

BACKGROUND OF THE INVENTION

Tool shop vacuum cleaners (e.g., wet-dry vacuums) are designed to collect debris from a work area or connected tool via suction. Such vacuums typically include a tank and motor that drives an impeller to generate an airstream within the tank. Since the airstream includes debris, care must be taken to prevent the debris from reaching the motor and causing damage. In light of this, conventional systems further include a filter positioned upstream from the motor to capture debris as the contaminated airflow passes through the tank. Over time, however, the debris accumulates on the filter, restricting airflow and hampering performance. For example, a filter initially enabling airflow of approximately 80 cfm may begin degrading within minutes of operation, diminishing airflow capacity to approximately 10 cfm. Consequently, conventional vacuum systems require regular cleaning or replacement of the filter. This process requires a user to stop vacuum operation, open the tank, and remove the filter for cleaning or replacement. This is a time-intensive process that interrupts workflow.

Thus, it would be desirable to provide an airflow arrangement configured to clean a filter during operation, thereby increasing filter life and extending time between manual cleaning of the filter, as well as filter replacement.

SUMMARY OF THE INVENTION

The present invention is directed toward a construction site shop vacuum including a tank and a lid coupled to the tank. A separator plate is disposed within the vacuum such that the lid generally defines a motor chamber and the tank generally defines a collection chamber. The motor chamber houses a motor assembly, which is supported by the separator plate. The collection chamber, oriented upstream from the motor assembly, houses a filter system suspended from the separator plate. The separator plate includes conduits that permit airflow between the collection and motor chambers. Airflow between the chambers is controlled utilizing a valve assembly that selectively opens and closes the conduits.

Specifically, the valve assembly operates in a first mode, in which contaminated airflow is drawn into the collection chamber, passing through the filter system in a first direction. The filter medium of the filter system captures debris present in the airflow, cleaning the air passing therethrough. The filtered airflow is then directed into the motor chamber, exiting the vacuum as exhaust.

The valve assembly further operates in a second mode, in which at least a portion of the filtered airflow is redirected from the motor chamber back into the collection chamber. Specifically, the airflow is directed through the filter system in a second direction to expel debris that has accumulated on the filter medium. With this configuration, the media of the filter system are periodically cleaned during operation of the vacuum.

BRIEF DESCRIPTION OF THE DRAWINGS

FIG. 13F illustrates an enlarged side cross-sectional view of the manifold shown in FIG. 13A.

Like reference numerals have been used to identify like elements throughout this disclosure.

DETAILED DESCRIPTION OF THE INVENTION

Figure 1:
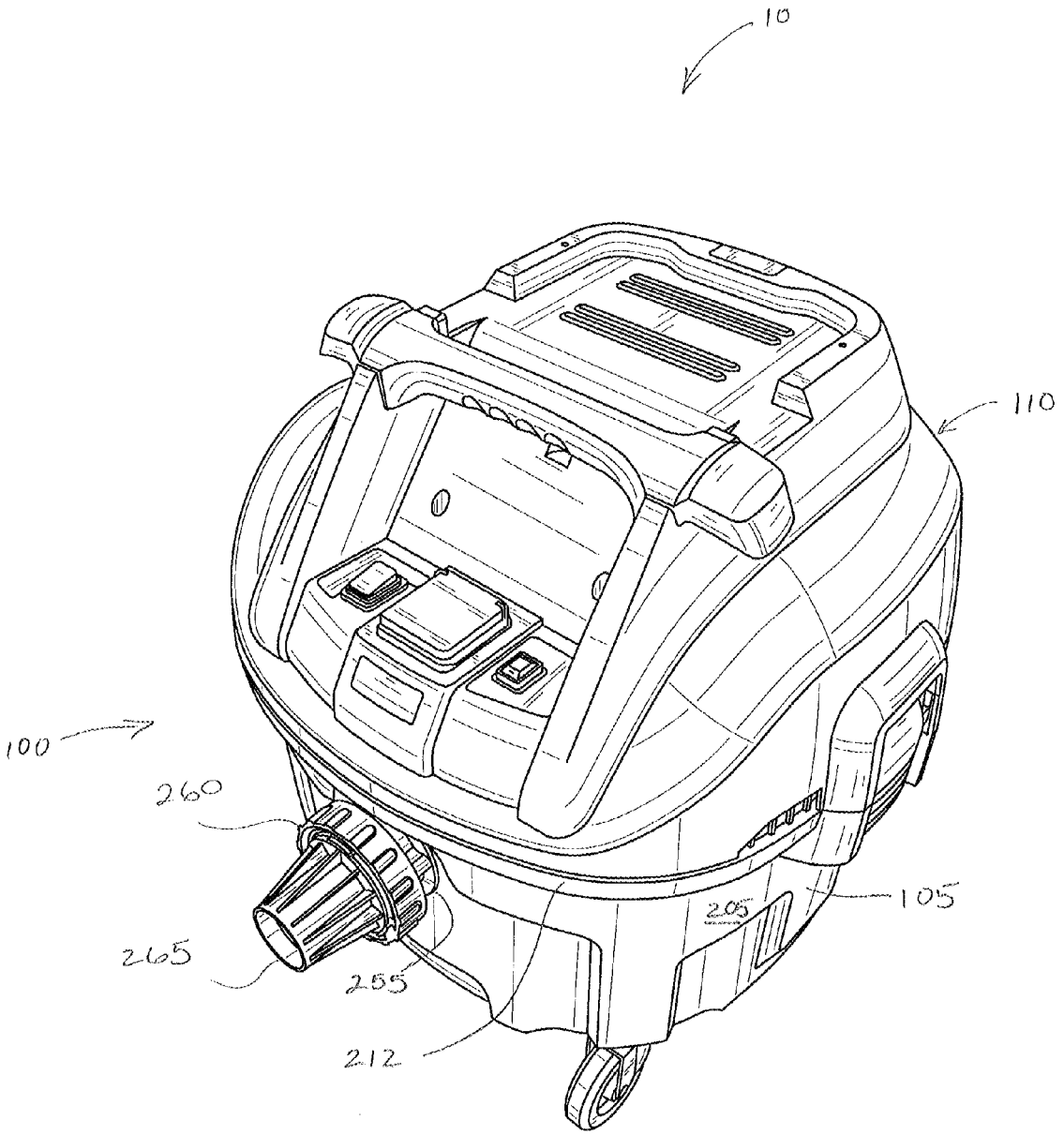
FIG. 1 illustrates a front perspective view of a vacuum in accordance with an embodiment of the invention.
Figure 2:
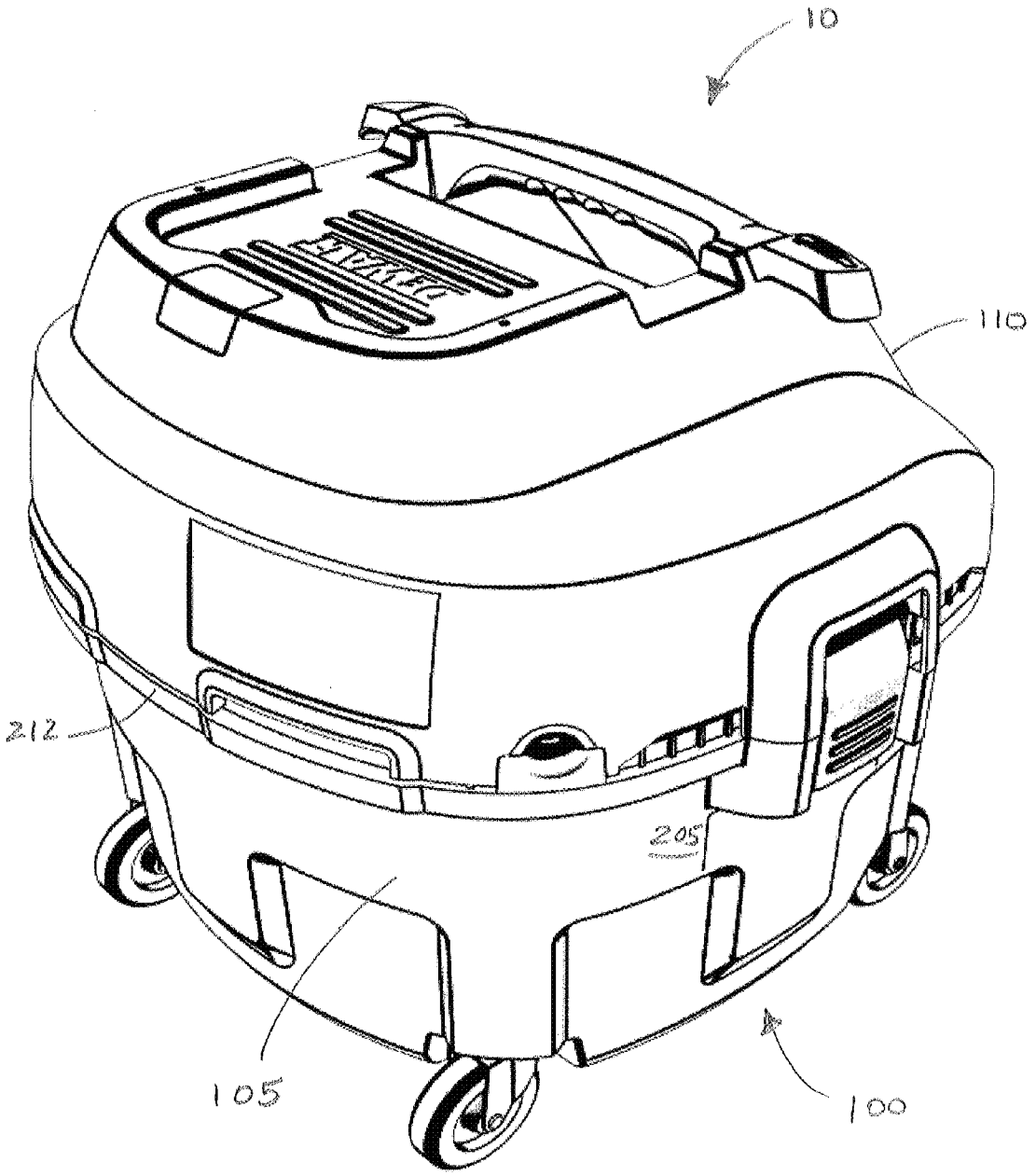
FIG. 2 illustrates a rear perspective view of the vacuum device shown in FIG. 1.

Referring to FIGS. 1 and 2, a vacuum system 10 in accordance with an embodiment of the invention (e.g., a wet/dry vacuum cleaner) includes a body 100 having a tank portion 105 coupled to a head or head 110 via one or more latch devices 112. Tank 105 may possess any dimensions and shapes suitable for its described purpose.

The tank portion 105 may further include one or more latch receptacles formed into the side wall 205. Each latch receptacle receives a corresponding latch device operable to couple the tank 105 to the head 110.

Figure 3:
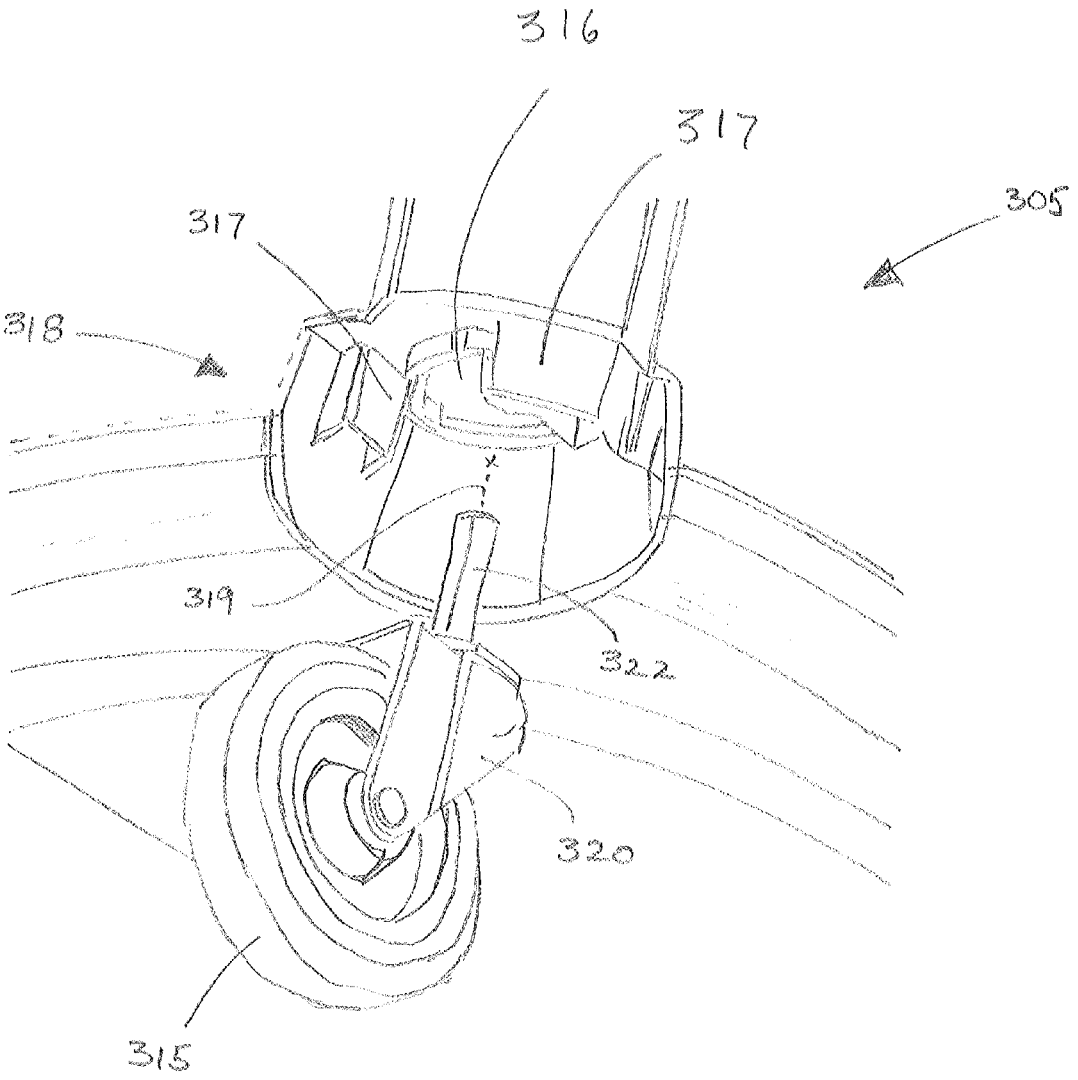
FIG. 3 illustrates a wheel assembly structure for rollably supporting the vacuum on a floor surface.
Figure 4:
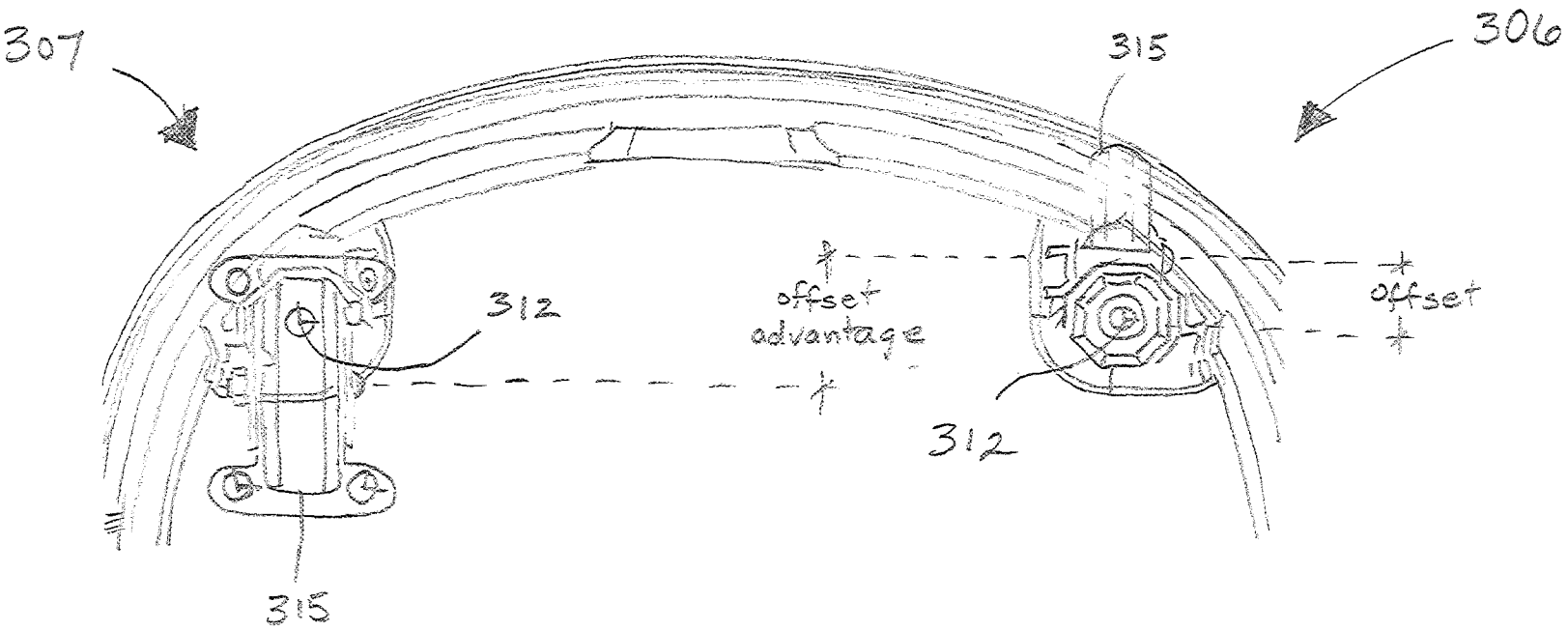
FIG. 4 illustrates an arrangement of the wheel assembly of FIG. 3 on the vacuum of FIG. 1.

Referring to FIGS. 3 and 4, a vacuum supporting wheel assembly (e.g., rear wheels) may be in the form of a caster 305 including a wheel 315 disposed below a support structure 318. The wheel 315 is rotatably mounted to a fork 320 that, in turn, is pivotally coupled to the support 318 via a central pin 322. Support 318 includes an opening 316 for receiving pin 322 having an axis 319. Wheel 315 may rotate about axis 319 in opening 316 or it may be held stationary as fork 320 is engaged by rotational stoppers 317. Fork 320 extends from pin 322 such that a rotational axis of wheel 315 does not intersect with an axis of pin 312. In this arrangement the axis of wheel 315 is offset from pin 322 as shown at the right in FIG. 4 The wheel base is thereby shifted rearward providing for a larger wheel base with respect to the front wheels of the vacuum than a non-offset or centrally mounted wheelbases such as shown at the left in FIG. 4. FIG. 4 illustrates how the offset pinned caster arrangement 306 provides a greater wheel base than the centrally arranged caster arrangement of 307.

(e.g., rear wheels) Referring back to FIG. 1, the tank 105 further includes an intake port 255 formed into the side wall 205 (along the forward portion of the side wall). A vacuum connector 260, secured to the exterior side of the intake port 255, couples to a hose connector 265, which, in turn, couples to a flexible tube (e.g., a hose) utilized to capture debris.

Figure 6A:
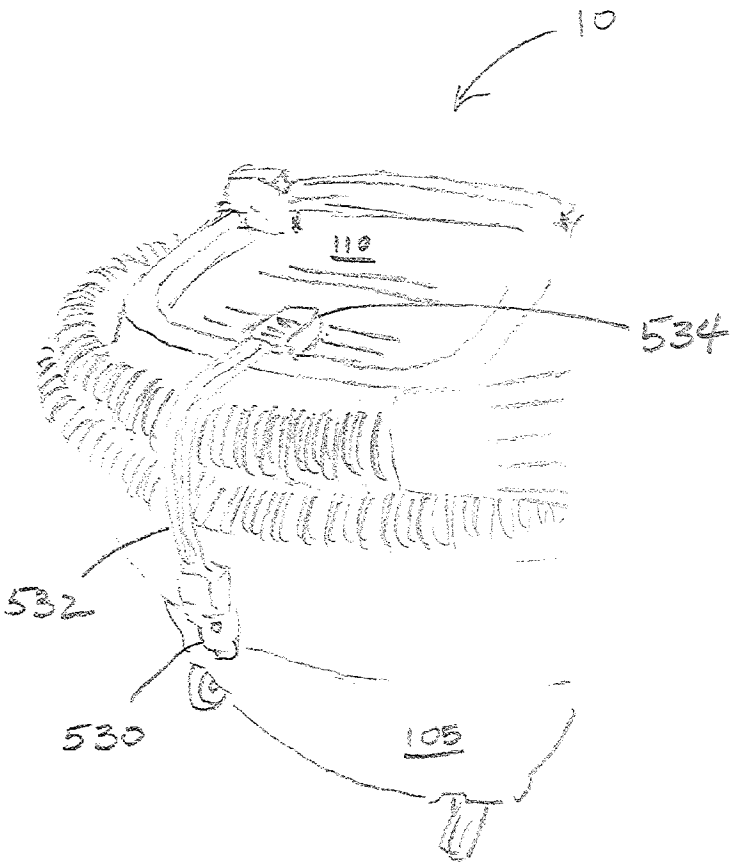
FIG. 6A illustrates the hook and strap of FIG. 5 securing a hose to the vacuum of FIG. 1.
Figure 5:
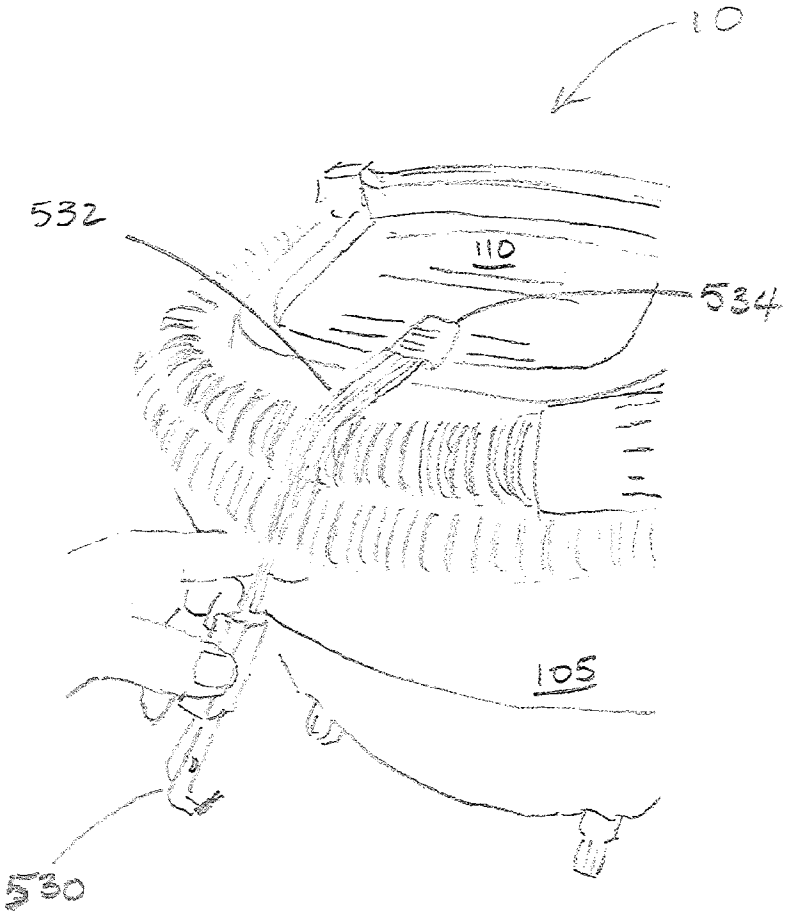
FIG. 5 illustrates a hook tethered by a flexible strap to a connector secured to the vacuum of FIG. 1.
Figure 6B:
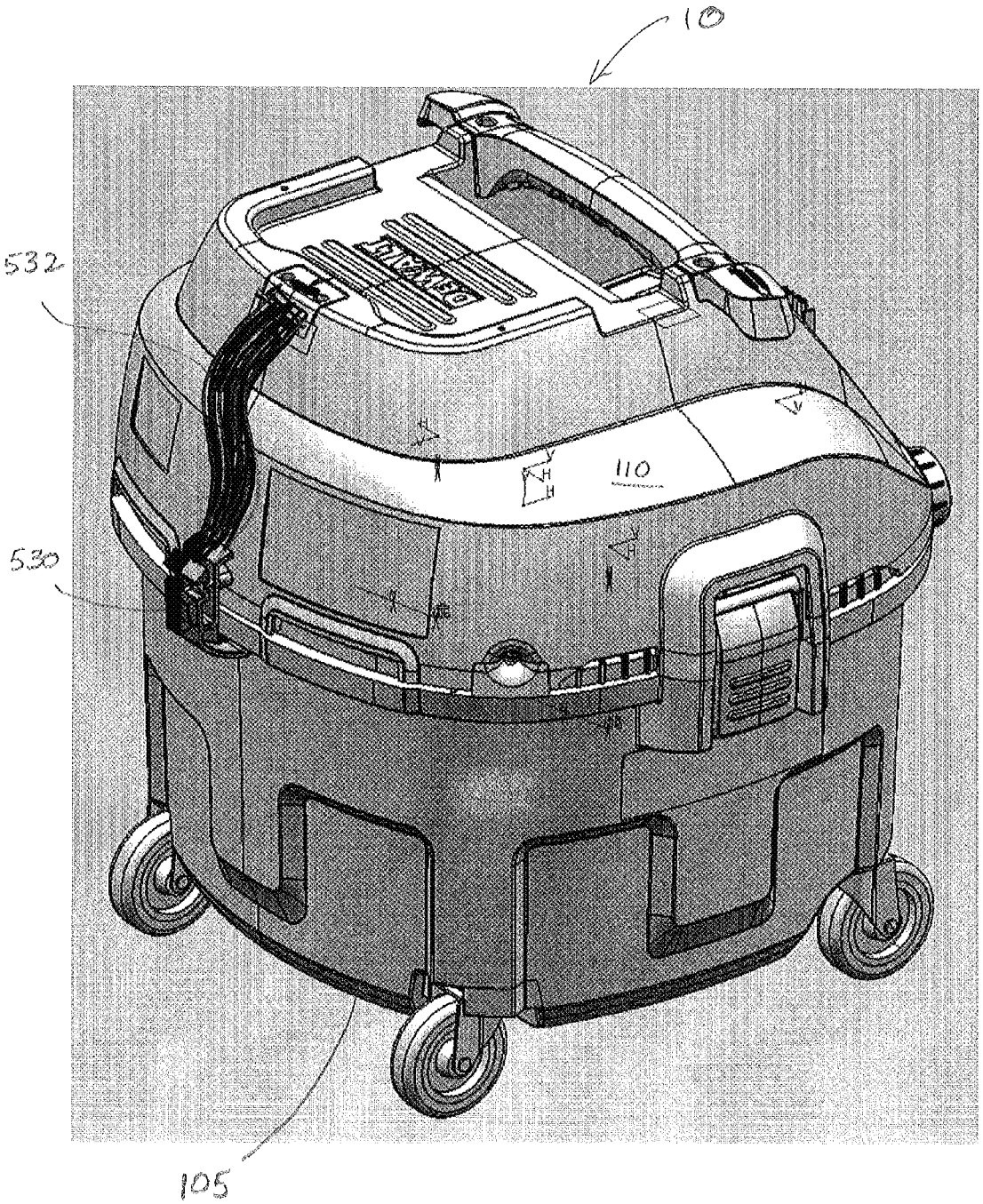
FIG. 6B illustrates the hook and strap of FIG. 5 secured respectively to a lip of a tank and a head of the vacuum of FIG. 1.

As illustrated in FIGS. 5, 6A and 6B, a hook 530 is tethered to the vacuum via a flexible cord 532. The cord is connected to an anchor 534 on an opposite end of the cord from the hook. The anchor is secured to the vacuum (e.g., on the head 110 of the vacuum). The hook may be pulled so that the cord extends around an object (e.g., the debris suction hose mentioned above) and then hooked to the vacuum.

Figure 7A:
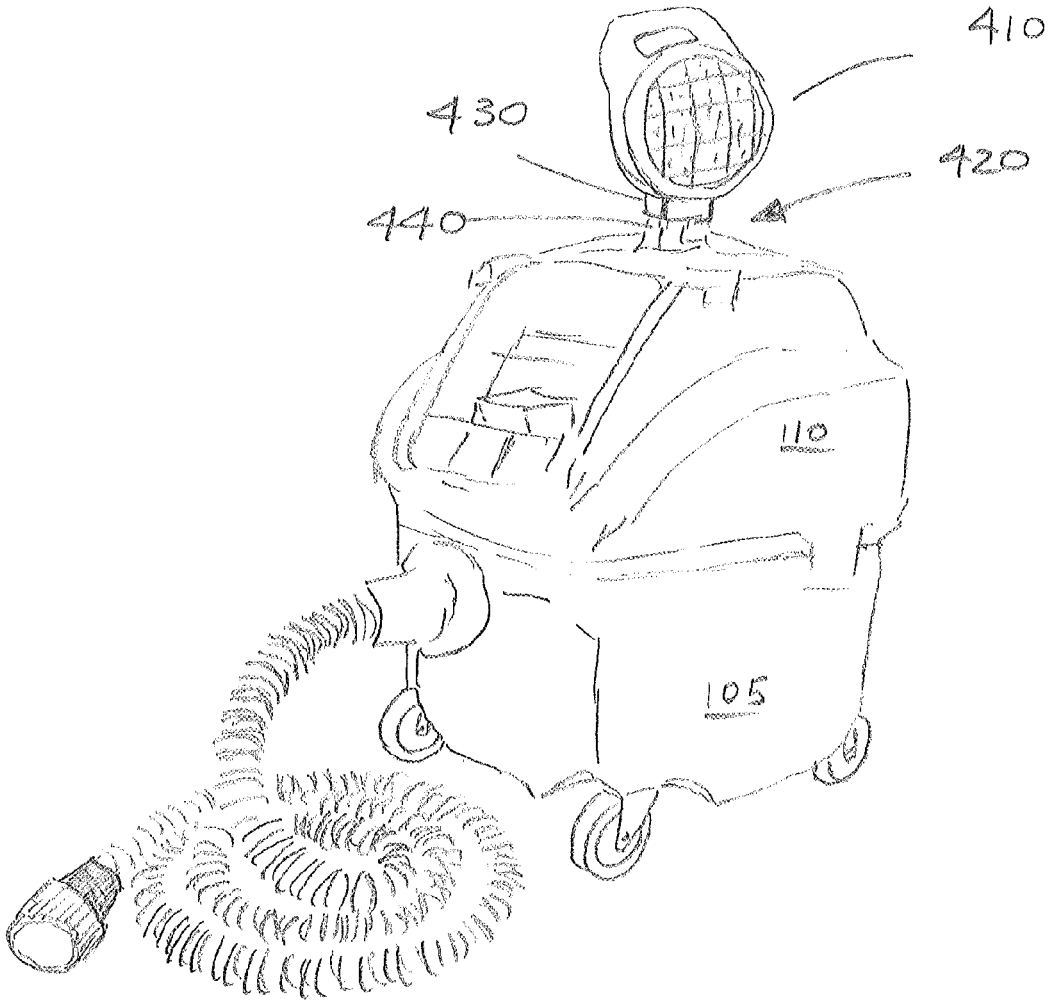
FIG. 7A illustrates a light source and pivotable support structure attached to the vacuum of FIG. 1.
Figure 7B:
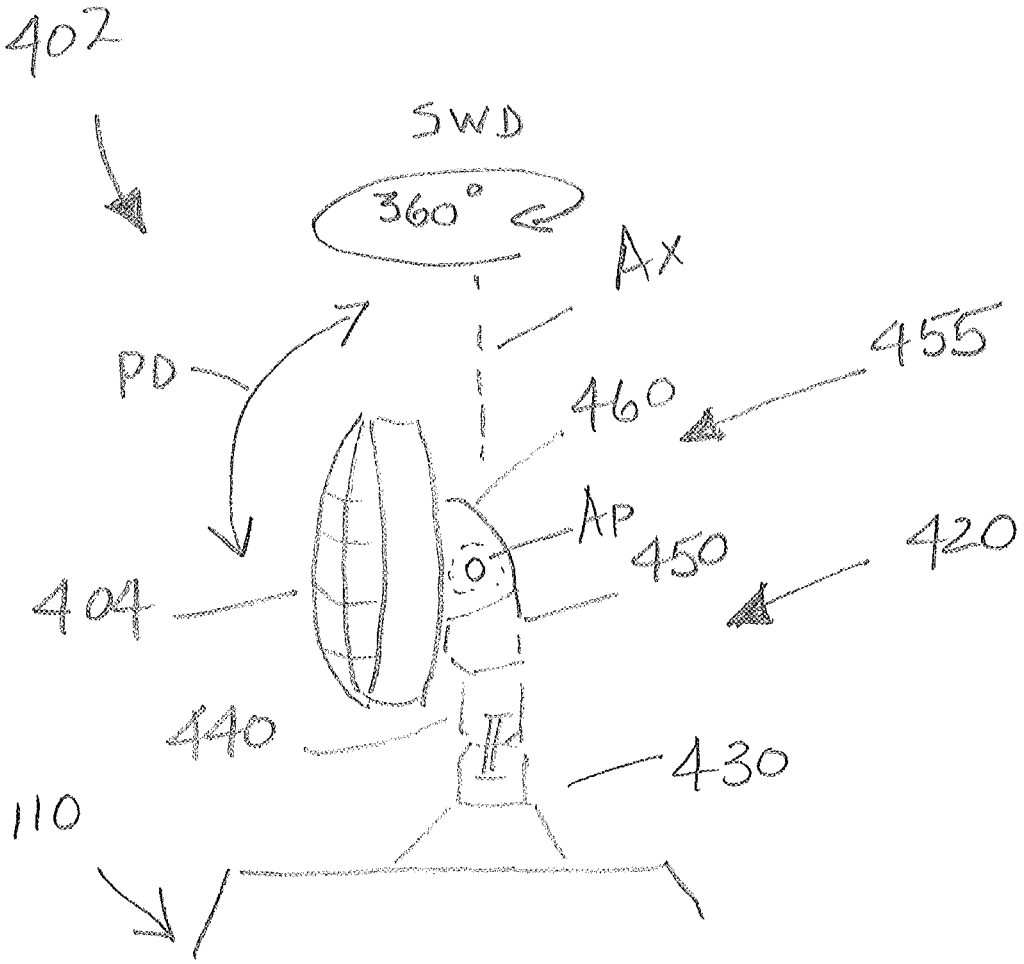
FIG. 7B illustrates an enlarged view of the light source and pivotable support structure of FIG. 7A.

A light 402 may be secured to a top of head 110. The light may include a halogen lamp 404 or other type light. FIGS. 7A and 7B illustrate the light accessory. The light may pivot about an axis Ap and rotate about an axis Ax. A rotation structure 420 includes a first rotator 430 that is secured to the vacuum body 100 and a second rotator 440 that is fixed to and rotates with lamp 404, but relative to first rotator 430. A pivot structure 455 which is attached to second rotator 440 includes a first pivot 450 that pivots relative to a second pivot 460 about an axis Ap. Lamp 404 is attached to second pivot so that it can pivot up and down about axis Ap in a direction PD relative to body 100. Lamp 404 can also swivel or rotate 360° about axis Ax in the SWD direction. The lamp can be powered by an independent extension cord to a wall outlet or power may be supplied by the vacuum directly or through an outlet socket on the vacuum (supplied by the vacuum main power cord).

Figure 8A:
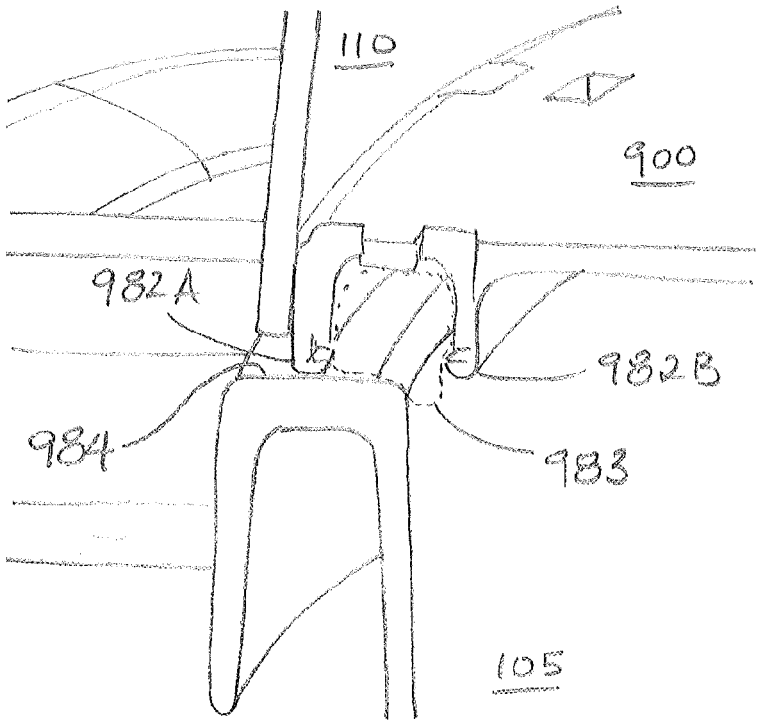
FIG. 8A illustrates a cross sectional view of a sealing mechanism.
Figure 8B:
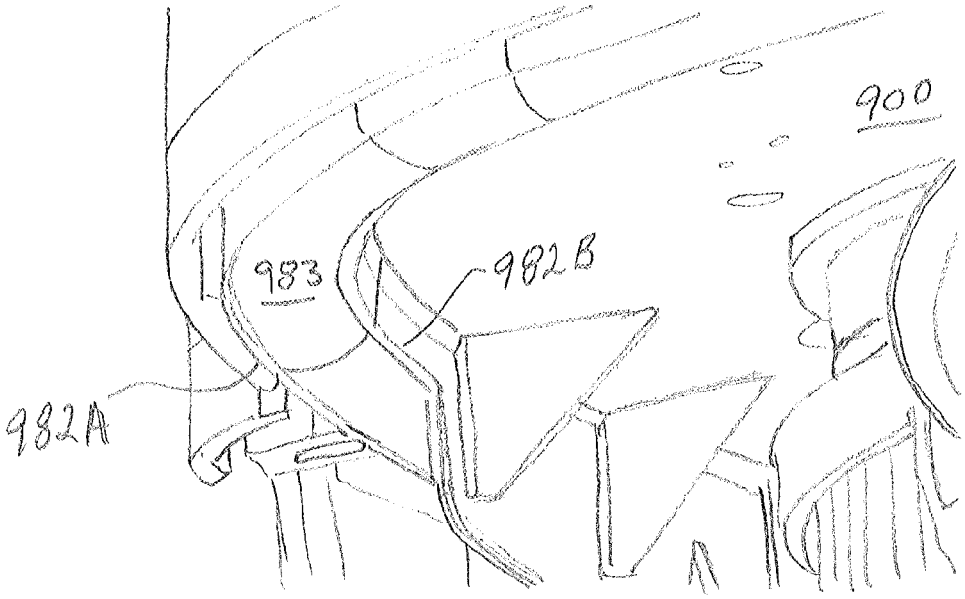
FIG. 8B illustrates a bottom perspective view of the sealing mechanism of FIG. 8A.

FIGS. 8A and 8B illustrate the interface and seal between head 110 and tank 105. Two vertical walls 982A and 982B extend downward from the outer lower surface of separator plate 900. At lower distal ends of the walls inwardly facing projections may extend. A channel or strip 983 of flexible sealing material (e.g., foam) may be inserted between the walls and within the projections to secure the material within the walls and projections. The channel 983 is shown deformed in FIG. 8A may be made of foam, rubber, flexible polymer or any suitable flexible material that may provide a good vacuum seal between head 110 and tank 105. When assembled, channel 983 may extend below the walls 982A and B. When head 110 is sealed to tank 105, channel 983 is forced into contact with rim surface 984 of tank 105 thereby fluidly sealing the interface between tank 105 and head 110.

Figure 9A:
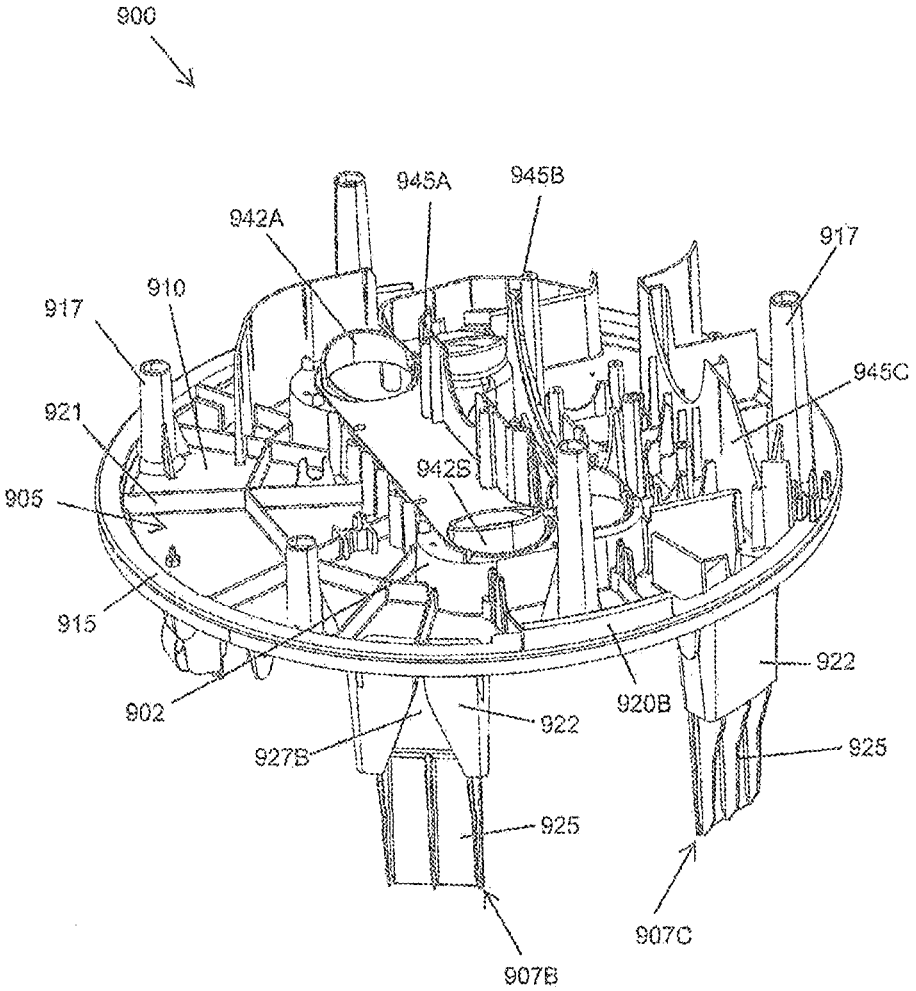
FIG. 9A illustrates an isolated view of a separator plate in accordance with an embodiment of the invention.
Figure 9B:
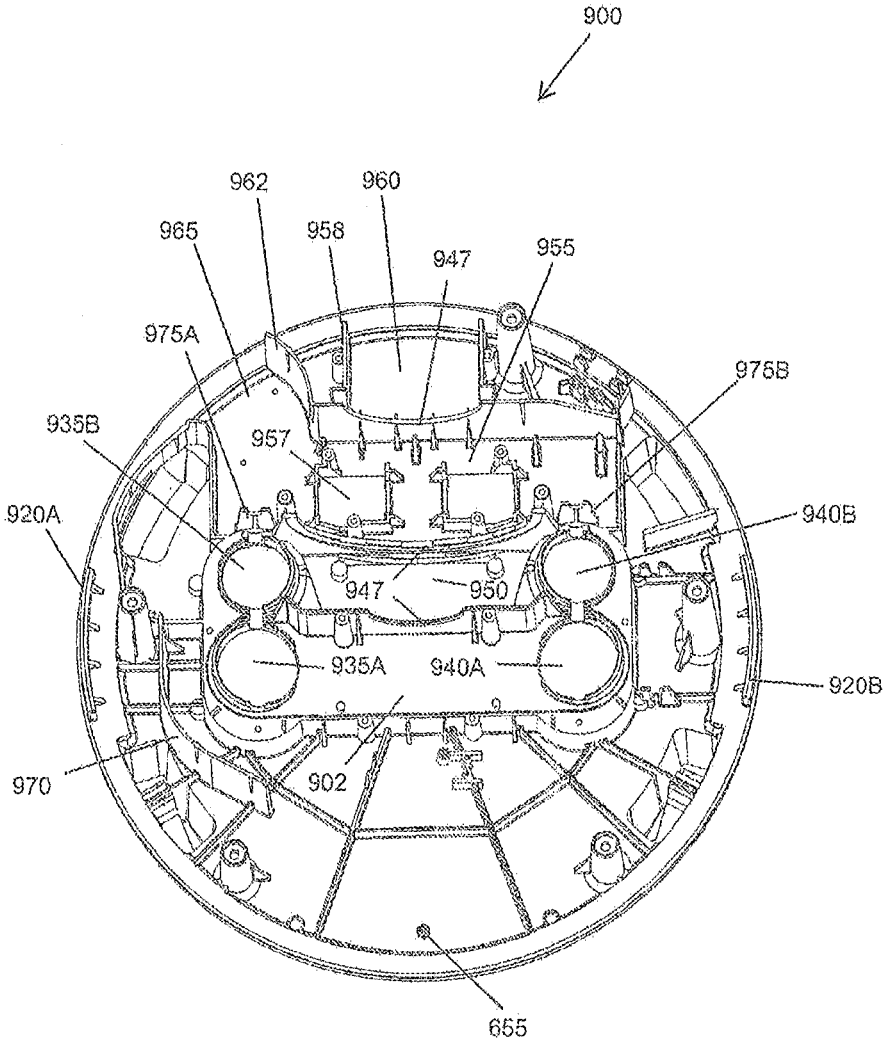
FIG. 9B illustrates a top perspective view of the separator plate shown in FIG. 9A.
Figure 9C:
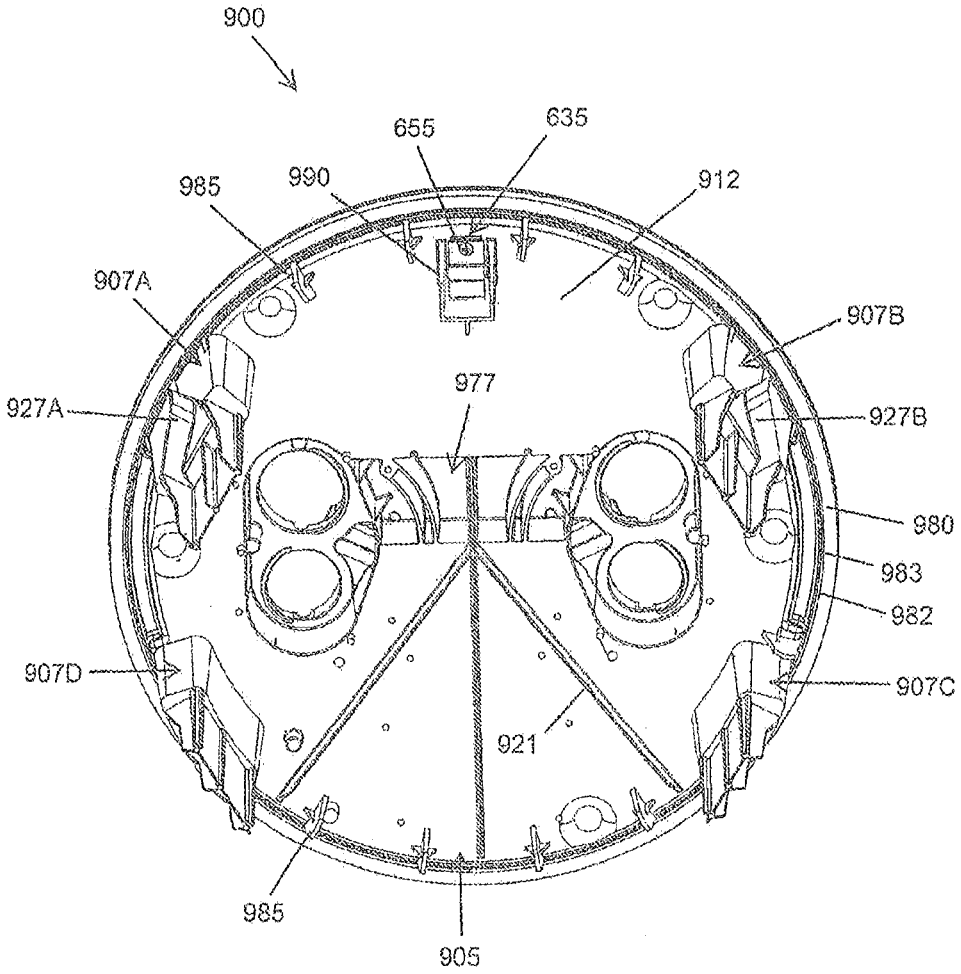
FIG. 9C illustrates a bottom perspective view of the separator plate shown in FIG. 9A.

Referring to FIGS. 9A, 9B, and 9C, a separator plate 900 engages the tank rim 212, separating the tank cavity 214 (the collection chamber) from the cavity of the vacuum head 110 (also called a motor chamber). The separator plate 900 includes a platform 905 (e.g., a generally circulate plate) and one or more leg members 907A-907D. The platform 905 includes an upper (head facing) surface 910 and a lower (tank facing) surface 912. The shaped and dimensions of the platform 905 may be any suitable for its described purpose. By way of example, the platform 905 may be substantially planar and possess a generally circular shape. A perimetral wall 915, protruding upward from the platform upper surface 910, extends about the circumference of the platform 905. As noted above, the upper surface 910 of the platform 905 may further include one or more connection posts 917 that engage (e.g., mate, receive, etc.) corresponding connection posts 707 extending from the vacuum head 110. Fasteners may extend through the connection posts 707, 917 to secure the lid 110 to the separator plate 900. A pair of diametrically opposed lips 920A, 920B extends axially (upward) from the perimetral wall 915 to provide an engagement member for each of the latch devices 112, as described above. The platform 905 may further include one or more reinforcing ribs 921 spanning the platform upper surface 910 to enhance the strength of the platform.

Figure 15A:
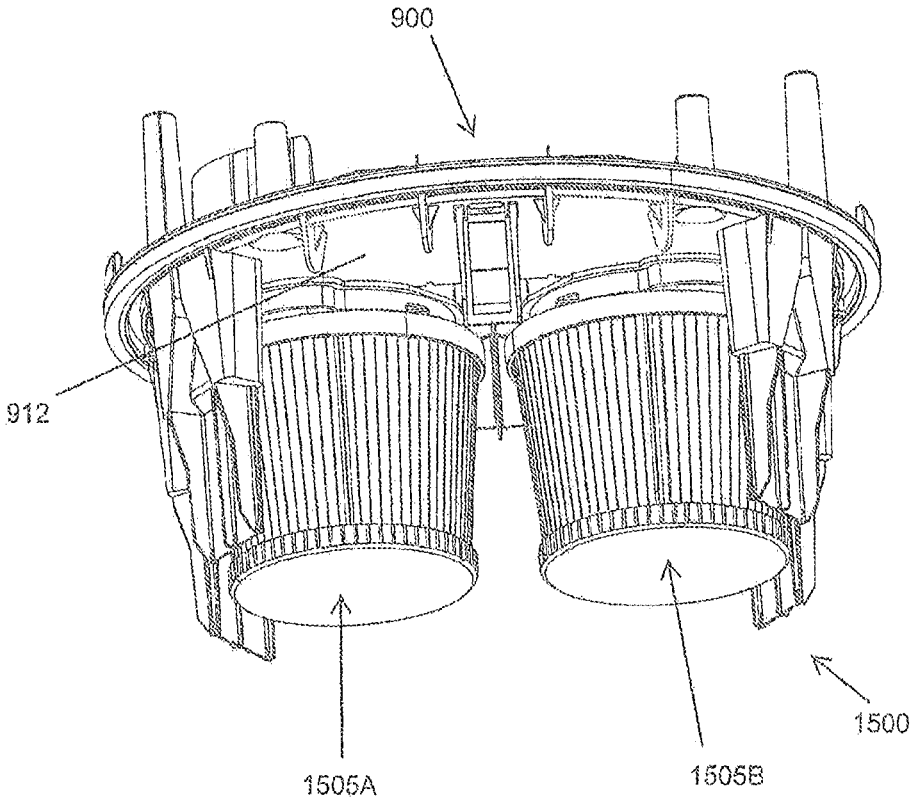
FIG. 15A illustrates a perspective view of a filter assembly in accordance with an embodiment of the invention, shown mounted on the separator plate of FIG. 9A.

The leg members 907A-907D, extending distally from the platform lower surface 912, are configured to elevate the platform 905 and, in particular, to suspend the filter system above a supporting surface when the separator is placed directly upon the supporting surface. That is the length of the legs is selected to prevent the filters from contacting the ground when the separator plate 900 and/or head 110 is removed from the tank and set on a surface (seen in FIGS. 7E and 15A). The leg members 907A-907D are located proximate the outer edge of the separator plate, being disposed a predetermined angular positions thereon.

The leg members 907A-907D, moreover, are configured to key the separator plate 900 to the tank 105 such that the separator plate is oriented in a specific rotational position when inserted into the tank 105. As shown in the figures, the platform 905 includes a first forward leg 907A, a second forward leg 907B, a first rearward leg 907C, and a second rearward leg 907D. Each leg 907A-907D includes a proximal leg portion 922 and a distal leg portion 925. The proximal leg portion 922 of the forward legs 907A, 907B includes a notch 927 (e.g., a tapered (V-shaped) notch) configured to receive the guide element 675A, 675B protruding from the interior surface 670 of the tank 105. As explained above, the guide element 675A, 675B is positioned at predetermined positions along the tank. The notch 927 aligns with each of the tank guide elements 675A. 675B such that the first guide element 675A is received within the notch of the first forward leg 907A and the second guide element 675B is received within the notch of the second forward leg 907B. Consequently, in order for the separator plate 900 to be inserted into the tank cavity, the notch 927A of first leg member 907A must be aligned with the first guide element 675A and the notch 927B of the second leg member 907B must be aligned with the second guide element 675B. Should the forward (notched) leg members 907A, 907B not be aligned with their corresponding guide elements 675A, 675B (i.e., should the rotational position of the separator plate 900 differ from the normal/predetermined position such that no leg or an unnotched leg is aligned with the guide elements), insertion of the separator plate 900 into the tank cavity 214 will be prohibited.

The separator plate 900 further includes a conduit system to enable the flow of air between the tank 105 (the collection chamber 214) and the head 110 (the motor chamber). In the embodiment illustrated, the platform 905 of the separator plate 900 includes a central, raised platform or deck 902 with a first conduit pair 935 and a second conduit pair 940. The first conduit pair 935 includes a first (forward) suction conduit or port 935A and a first (rearward) cleaning conduit or port 935B. Similarly, the second conduit pair 940 includes a second (forward) suction conduit or port 940A and a second (rearward) cleaning conduit or port 940B. The conduits 935A, 935B of the first conduit pair 935 are positioned such that the conduits are disposed over the first filter 1505A (FIG. 15) of the filter system, while the conduits 940A, 940B of the second conduit pair 940 are positioned such that they are disposed over the second filter 1505B of the filter system (i.e., each filter is in fluid communication with a conduit pair).

The conduits 935A, 935B, 940A, 940B may possess any shape and dimensions suitable for their described purpose. By way of example, each conduit 935A, 935B, 940A, 940B may be generally cylindrical. Each conduit, moreover, may include a conduit baffle operable to direct the airflow in a predetermined direction. As seen best in FIG. 9A, the suction conduit 935A, 940A may include an inboard conduit baffle 942A that curves radially inward with respect to the platform 905 to direct the air inboard, while the cleaning conduits 935B, 940B may include an outboard conduit baffle 942B that curves radially outward to direct air outboard (toward the perimeter of the platform).

The upper surface 910 of the platform 905 further includes first 945A, second 945B, and third 945C support walls that cooperate to support the airflow assembly. As shown, the first support wall 945A extends upward from the upper surface 910 of the platform 905, being oriented between the suction 935A, 940A and the cleaning 935B, 940B conduits. The second support wall 945B is disposed proximate the cleaning conduits 940A, 940B (i.e., is disposed outboard with respect to the first support wall). The third support wall 945C, moreover, is positioned outboard from the second support wall 945B. Each support walls 945A-945C is spaced from its adjacent support wall to define a cavity therebetween. Specifically, the first 945A and second 945B support walls define a fan cavity 950 that receives the fan of the airflow assembly. Similarly, the second 945B and third 945C support walls cooperate to define a motor cavity 955 that receives the motor of the airflow assembly. Each support wall 945A, 945B, 945C includes a cut-out section 947 that receives and supports various components of the airflow assembly. By way of example, the second and third support walls cooperate to support the motor of the airflow assembly, with the motor resting within the cut-out section. The motor cavity 955 further includes areas 957 for supporting valve solenoid switches (discussed in greater detail below).

The separator plate 900 further includes a pair of opposed motor intake walls 958 extending from the third support wall 945C to the perimetral wall 915. The motor intake walls 958 cooperate with a motor shroud 1205 (FIG. 12A) to define a motor air intake area 960 that aligns with second head vent 715B. Similarly, opposed walls 962 cooperate with the motor shroud 1205 to define a motor exhaust area 965 that aligns with third head vent 715C.

A deflection wall or baffle 970 extends upward from platform upper surface 910 (e.g., the height of the wall may be substantially equal to or greater than the height of the deck 902). The platform baffle 970 is positioned between the deck 902 and the perimetral wall 915. The platform baffle 970 gradually curves such that it extends from a position along a lateral side of the deck 902 to a position along the forward side of the deck. The platform baffle 970 is operable to direct cooling air exhausted by the manifold 1305 (FIG. 13A) toward electronics housed within the head 110, thereby cooling the electronics (discussed in greater detail below).

The platform 905 further includes a first yoke 975A located proximate the first cleaning conduit 935B and a second yoke 975B located proximate the second cleaning conduit 940B. Each yoke 975A, 975B supports an associated butterfly valve 1005A, 1005B (FIG. 10A) of the valve assembly to enable rotation of the valve on the yoke (discussed in greater detail below).

A series of downward-extending, angled fins 985 may be angularly spaced about the platform 905, being located near the outer edge of the platform, proximate the shoulder 980. The fins 985 serve as guides during the insertion of the separator plate 900 into the tank cavity 214. A bracket 990 is also disposed on the platform lower surface 912 that receives the conductive member 635 of the electrostatic discharge device. As shown, the conductive member 635 is coupled to the platform 905 via the conductive fastener 655.

Figure 10A:
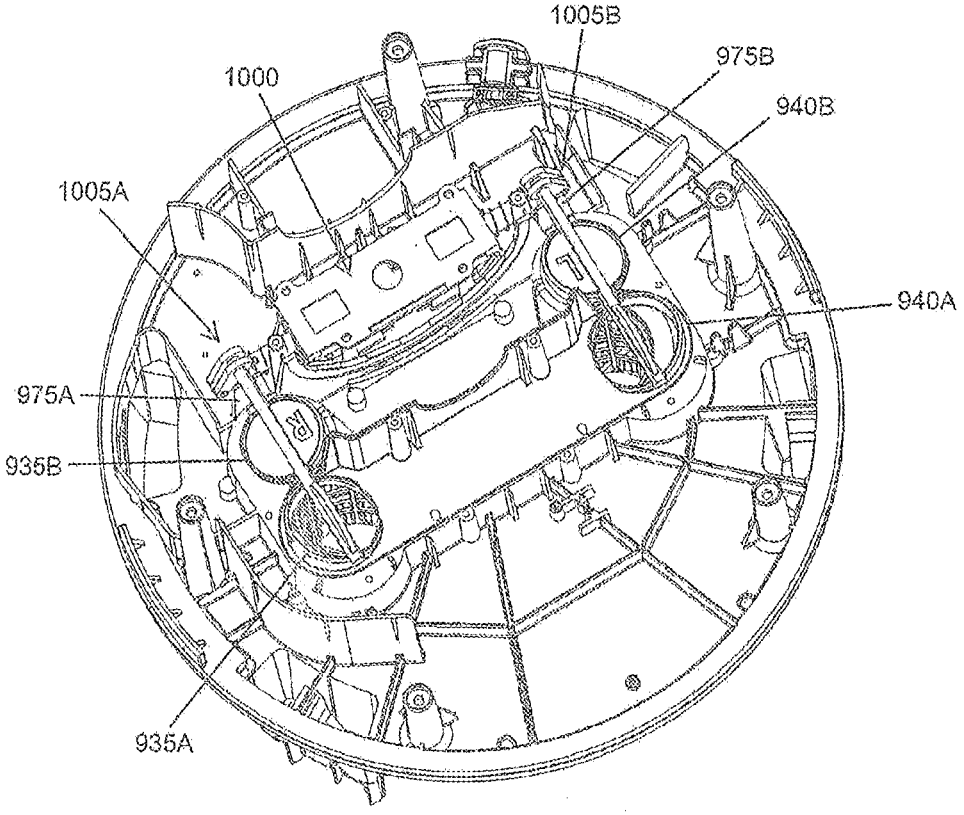
FIG. 10A illustrates a top perspective view of a valve assembly in accordance with an embodiment of the invention, the valve assembly being mounted on the separator plate of FIG. 9A.
Figure 10B:
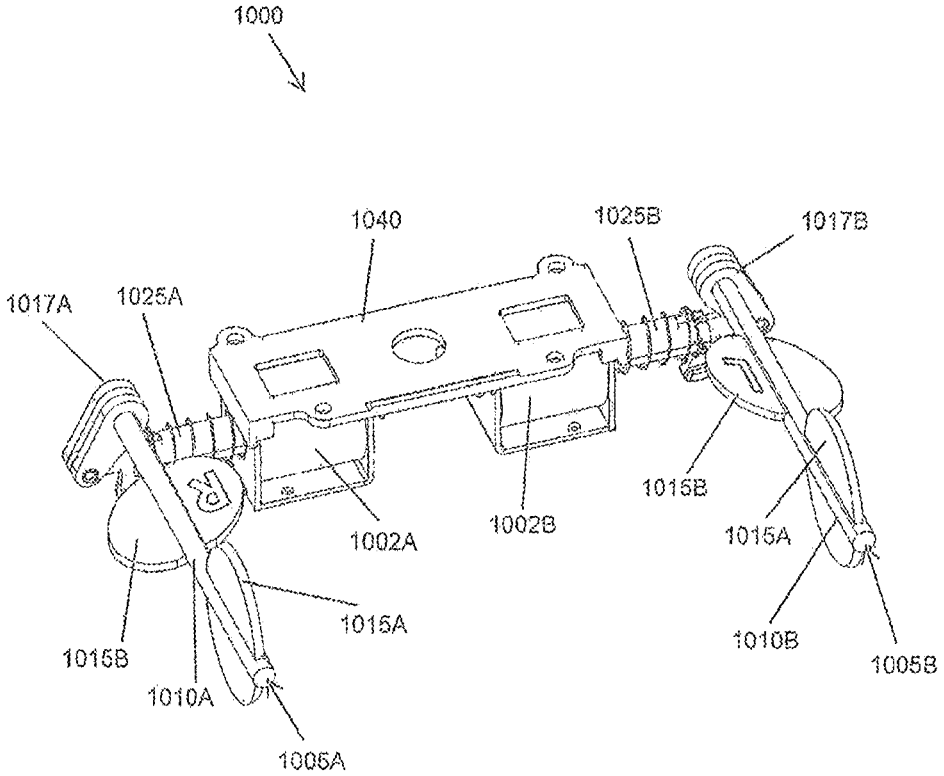
FIG. 10B illustrates an isolated, front perspective view of the valve assembly shown in FIG. 10A.
Figure 10C:
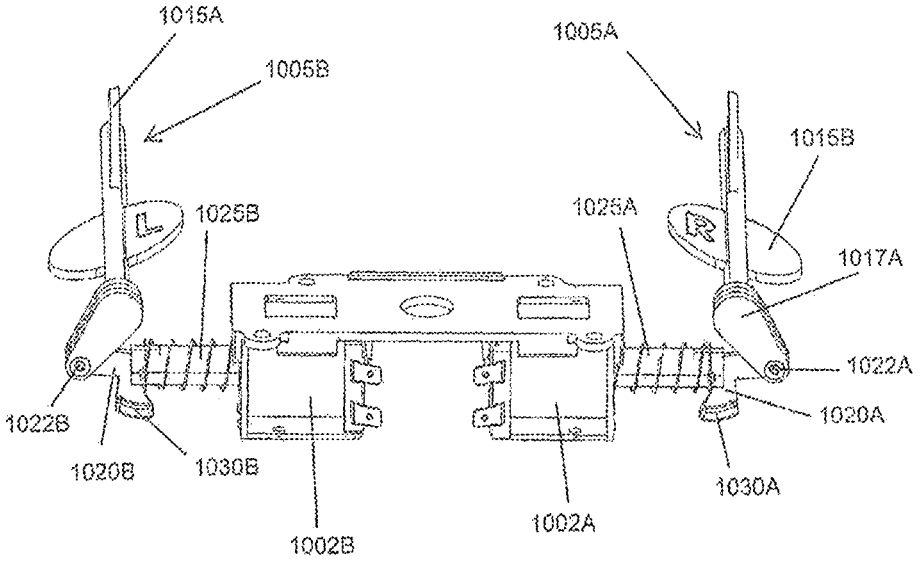
FIG. 10C illustrates an isolated, rear perspective view of the valve assembly shown in FIG. 10A.

A valve assembly, disposed on platform upper surface 910, opens and closes one or more of the separator conduits 935A, 935B, 940A, 940B to selectively permit fluid (air) therethrough. In the embodiment illustrated in FIGS. 10A-10C, the valve assembly 1000 includes a first solenoid 1002A in communication with to a first butterfly valve 1005A and a second solenoid 1002B in communication with to a second butterfly valve 1005B. The first butterfly valve 1005A is supported by the first platform yoke 975A, while the second butterfly valve is supported by the second platform yoke 975B. As seen in FIG. 10A, the valve assembly 1000 is positioned on the separator plate 900, with each solenoid 1002A, 1002B being positioned within areas 957 as described above. The solenoids 1002A, 1002B may be secured to the platform 905 by a cover or bridge 1040 coupled thereto.

The first butterfly valve 1005A selectively permits airflow through the first conduit pair 935A, 935B. Similarly, the second butterfly valve 1005B selectively permits airflow through the second conduit pair 940A, 940B. Each butterfly valve 1005A, 1005B includes an elongated shaft 1010A, 1010B supporting a first or distal disc 1015A and a second or proximal disc 1015B longitudinally spaced along the shaft and rotationally offset from the distal disc by, e.g., approximately 45°.

The proximal end of the shaft 1010A, 1010B is connected to a crank arm 1017A, 1017B, which, in turn, is pivotally coupled to a linking member 1020A, 1020B via a pivot pin 1022A, 1022B. The linking member 1020A, 1020B is repositioned via a plunger 1025A, 1025B that is driven by the solenoid 1002A, 1002B. Specifically, the plunger 1025A, 1025B reciprocates axially to rotate the discs. The linking member 1020A, 1020B may further include a downward-extending, curved support or ski 1030A, 1030B configured to slide along the platform upper surface 910 as the plunger 1025A, 1025B reciprocates. The ski 1030A, 1030B maintains the positioning of the plunger 1025A, 1025B with respect to the solenoid during the plunger's reciprocal motion, keeping the plunger aligned with the drum of the solenoid 1002A, 1002B and preventing the plunger from becoming jammed in the solenoid drum at full extension. With this configuration, each solenoid 1002A, 1002B may be selectively engaged to rotate the shaft 1010A, 1010B about its longitudinal axis in a clockwise or counter clockwise direction. The degree of rotation includes, but is not limited to, approximately 45°. FIGS. 10E and 10F respectively show alternate embodiment skis 1020C and 1020D. Ski 1020D also includes an opening location member 1022D disposed in proximity to the opening in which plunger 1025A would be pinned. Opening location member 1022D aids in positioning the plunger for pinning to ski 1020D and for maintaining ski 1020D orientation with respect to plunger 1025A.

As a result, the valve assembly 1000 may selectively position each disc 1015A, 1015B with respect to its associated conduit 935A, 935B, 940A, 940B to enable the passage of fluid (e.g., air) therethrough. In operation, the valve assembly 1000 rotationally positions the discs 1015A, 1015B in a first position, in which the suction conduits 935A, 940A are opened and the cleaning conduits 935B, 940B are closed. That is, the butterfly valve 1005A, 1005B positions the shaft 1010A, 1010B such that the first disc 1015A is oriented generally transverse to the opening defined by the suction conduit 935A, 940A (as illustrated in FIG. 10A), thereby permitting airflow between the tank 105 (the collection chamber 214) and the head 110 (the motor chamber). The second disc 1015B, meanwhile, is positioned such that the disc completely covers the opening of the cleaning conduit 935B, 940B preventing the flow of air between the head 110 to the tank 105. Alternatively, the valves 1005A, 1005B may rotationally position the discs 1015A, 1015B in a second (reversed) position, in which the suction conduits 935A, 940A are closed and the cleaning conduits 935B, 940B are opened.

Figure 10D:
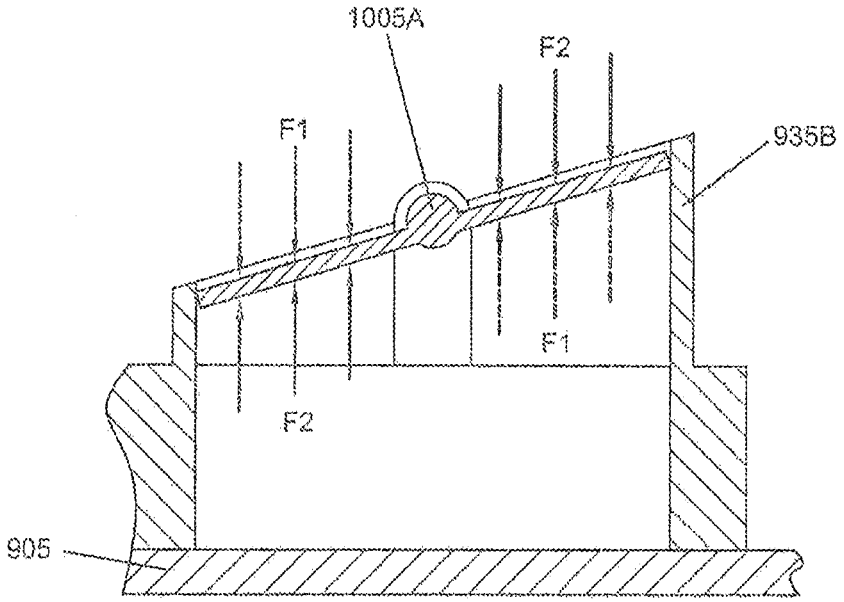
FIG. 10D illustrates a cross sectional view of a conduit and a valve of the valve assembly, showing the forces acting upon a disc.
Figure 10E:
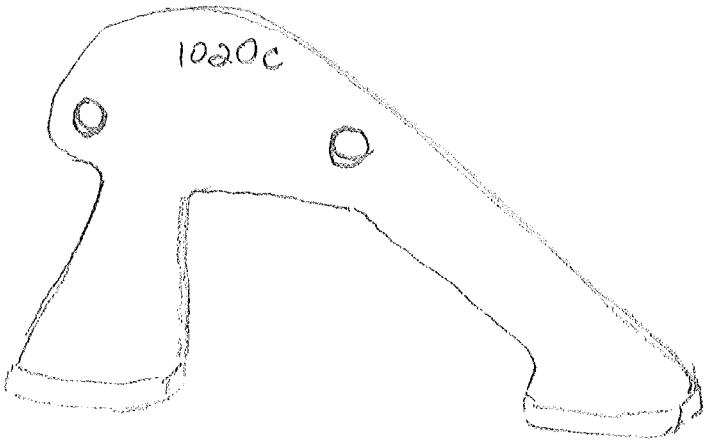
FIG. 10E illustrates a side perspective of an embodiment of a ski of the valve assembly of FIG. 10A.
Figure 10F:
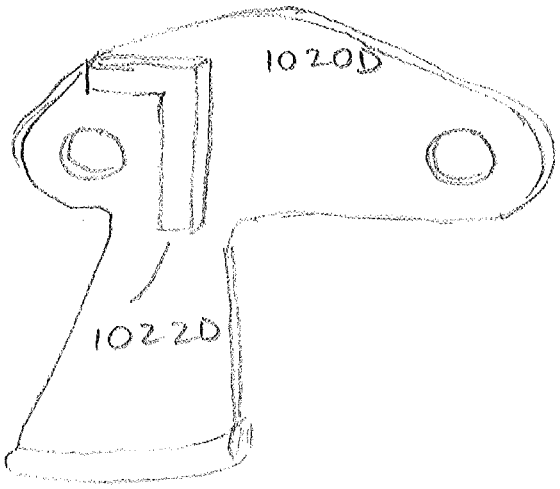
FIG. 10F illustrates a side perspective view of another embodiment of a ski of the valve assembly of FIG. 10A.

As shown in FIG. 10D, the conduits 935A, 935B, 940A, 940B and discs 1015A, 1015B are configured such that air flowing through the conduit creates a balanced system in which the forces on the butterfly valve 1005A, 1005B are equally applied across both surfaces of the disc 1015A, 1015B (indicated by arrows F1 and F2). Specifically, when an air pressure (positive or negative) is experienced on the upper side of the disk, the downward force (F1 upper) on one side of the rotating axis is generally equal to the downward force (F2 upper) on the other side of the axis. Therefore, a pressure on the top side of the disk does not significantly increase the force necessary to toggle the valve. Likewise, when an air pressure is experienced on the lower side of the disk, the upward force (F1 lower) on one side of the rotating axis is generally equal to the upward force (F2 lower) on the other side of the axis. Therefore, a pressure on the lower side of the disk does not significantly increase the force necessary to toggle the valve to its next operating condition. This enables the utilization of a small solenoid to rotate the valve 1005A, 1005B as described above, and provides an advantage over other valve types (e.g., piston valves, etc.) which have larger pressures to overcome and require large forces to toggle between operating positions. That is, the conduit structure enables the use of a lower power solenoid since valve rotation does not require overcoming a significant eccentric force applied to the disc 1015A, 1015B by the air in or airflow through the conduit.

Figure 11A:
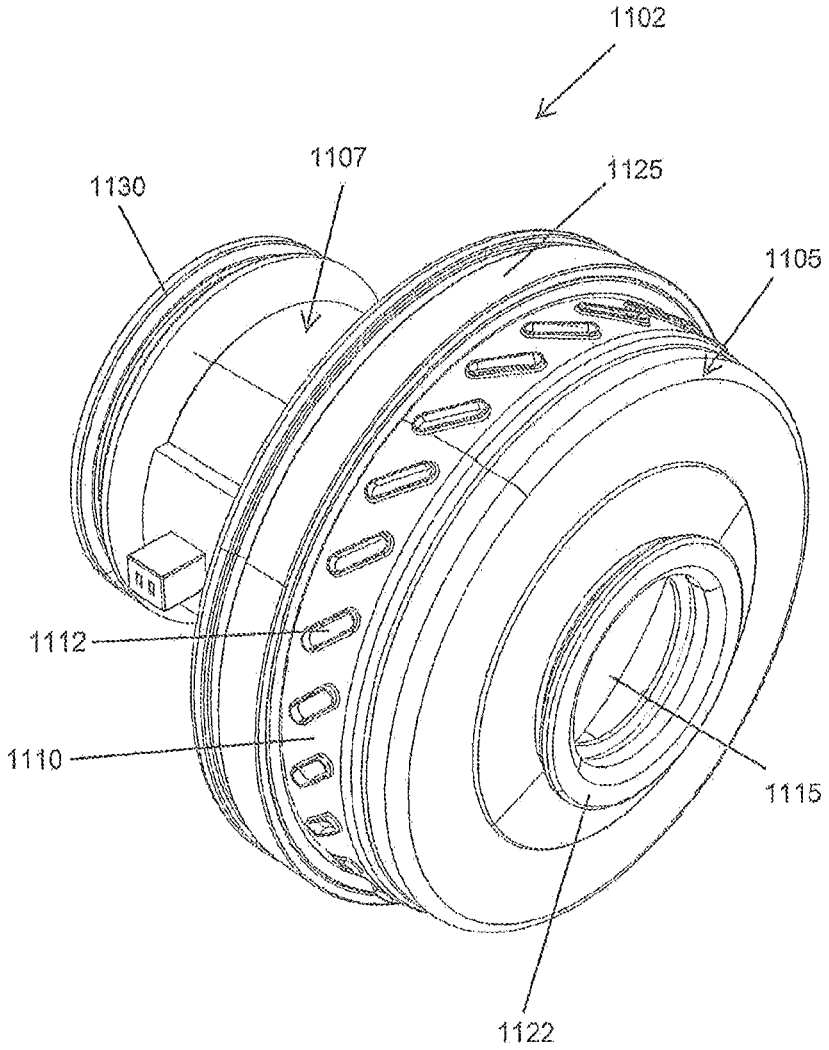
FIG. 11A illustrates an isolated view of an airflow assembly in accordance with an embodiment of the invention.
Figure 11B:
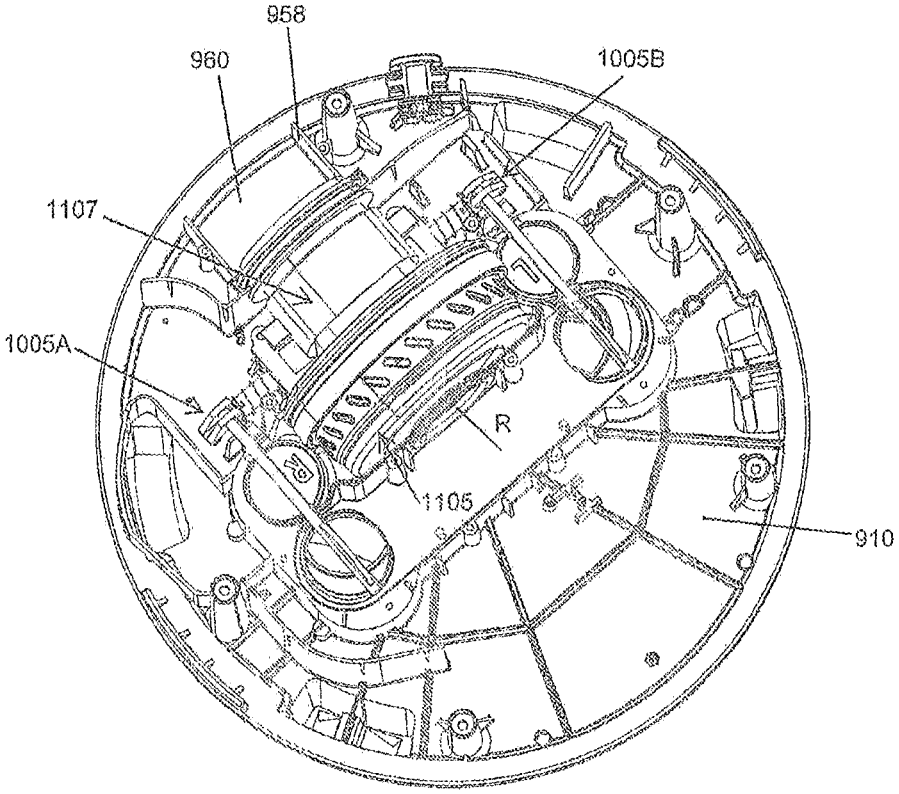
FIGS. 11B and 11C illustrate perspective views of the airflow assembly of FIG. 11A mounted on the separator plate shown in FIG. 9A.
Figure 11C:
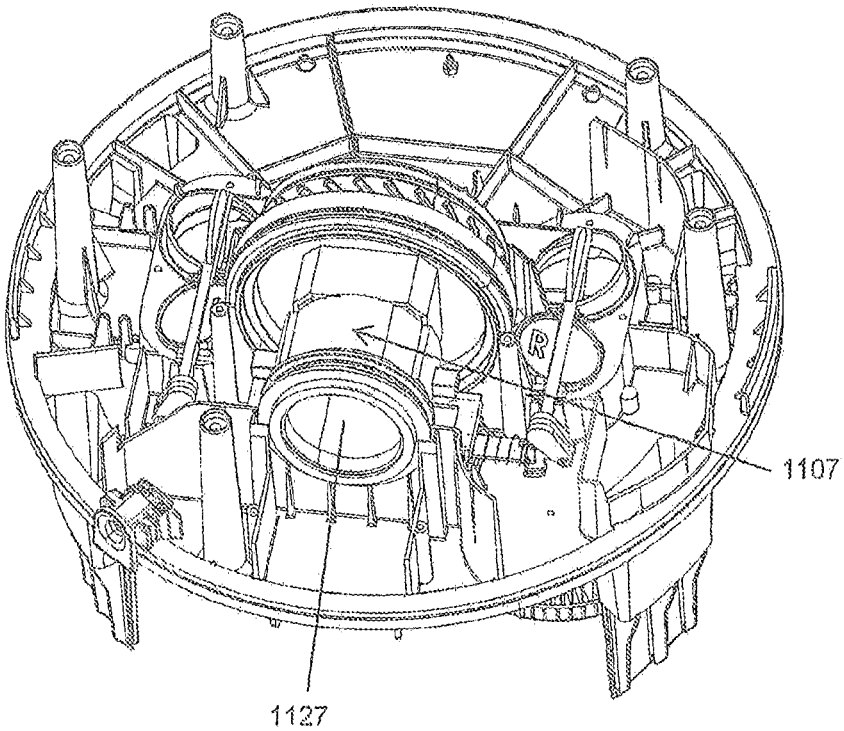

An airflow assembly, housed within the motor chamber defined by head 110 and supported on the upper platform surface 910, generates air pressure (positive and/or negative), within the vacuum device 10, as well directs the flow of air within the head 110. Referring to FIGS. 11A-11C, the airflow assembly includes an airflow generating device 1102 having a centrifugal fan 1105 driven by a motor 1107. The fan 1105 includes an annular housing or baffle 1110 and a plurality of slots 1112 disposed about the perimeter of the housing. The slots 1112 may be angled (e.g., offset and/or nonparallel to the rotational axis of the housing) to direct air in a predetermined direction. With this configuration, air is drawn into the central channel 1115 and is directed radially outward (from the fan rotational axis) through the slots 1112. The airflow generating device 1102 may further include a forward gasket 1122 coupled to the forward (inboard facing) side of the fan 1105, and a manifold spacer 1125 coupled to the rearward side of the fan. The motor 1107 may include any type of motor suitable for its described purpose. By way of example, the motor 1107 may include a universal series motor with a central channel 1127. The motor 1107 is configured to drive (e.g., rotate) the fan 1105 in a clockwise and/or counterclockwise direction, as well as to draw cooling air into the motor channel 1127. In an embodiment, the motor 1107 rotates the fan 1105 in a predetermined direction to generate a negative pressure within the vacuum device 10, which, in turn, generates a suction airstream (an intake airstream) that enters the tank portion 105 via the inlet port 255. As illustrated, the forward side of the motor 1107 may be coupled to the rearward (outboard facing) side of the fan 1105, and a rearward gasket 1130 may be coupled to the outboard side of the motor.

Referring to FIGS. 11B and 11C, the airflow generating device 1102 is oriented on the separator plate platform 905 such that it is located between the butterfly valves 1005A, 1005B, with the fan 1105 and manifold spacer 1125 being positioned within the fan cavity 950 of the platform 905, as well as aligned with the cut out section 947 formed into the first 945A and second 945B walls. The motor 1107, moreover, is position within motor cavity 955 such that the motor channel 1127 is aligned with the cut-out sections formed into the second 945B and third 945C platform walls. In a preferred embodiment, the fan 1105 is oriented such that its rotational axis R is oriented generally horizontally, i.e., such that the rotational axis is generally parallel to the platform 905 of the separator plate 900. Stated another way, the fan rotational axis R is oriented generally transverse (e.g. orthogonal) to the longitudinal axis of a filter 1505A, 1505B (FIG. 15). As such, the air intake direction of the fan 1105 may be oriented generally transverse (e.g., generally orthogonal) to the airflow passing through the conduit pairs 935, 940.

Figure 12A:
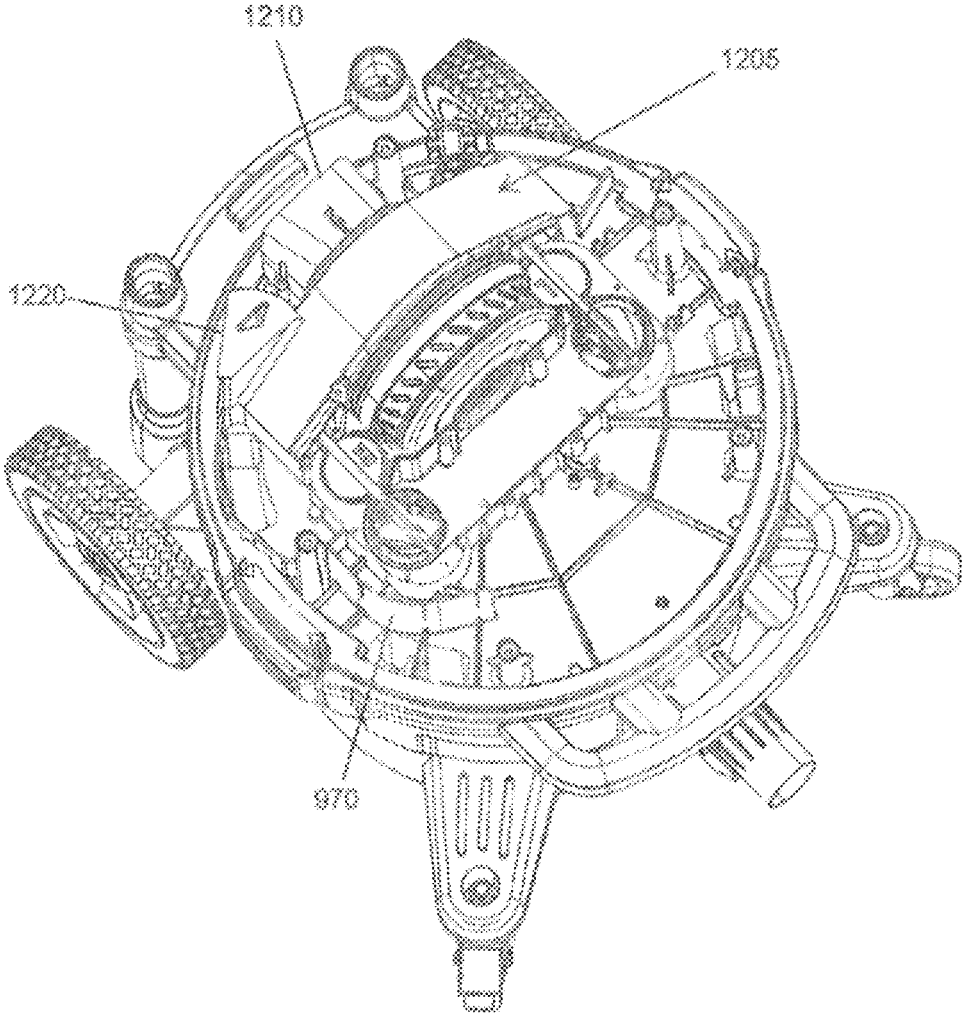
FIGS. 12A, 12B, and 12C illustrate the vacuum system with the vacuum head and manifold removed, showing a motor shroud mounted on the separator plate of FIG. 9A.
Figure 12B:
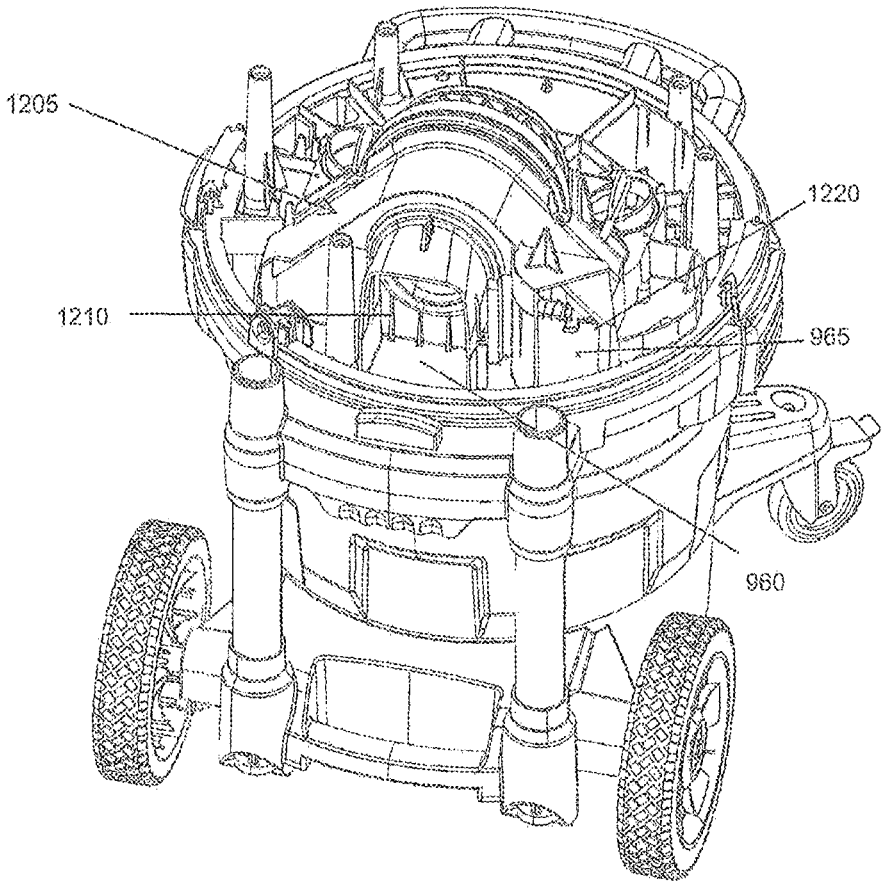

Referring to FIGS. 12A and 12B, the motor 1107 is housed in a motor shroud 1205 defining a motor air intake port 1210 and a motor air outlet or exhaust port 1220. The motor shroud 1205 separates the cooling airstream generated by the motor from the vacuum airstream. The intake port 1210 cooperates with walls 958 on the platform 905 to define the motor intake area 960 as described above. Similarly, the exhaust port 1220 cooperates with the walls 962 on the platform upper surface 910 to define the motor exhaust area 965 as described above. In operation, the ambient air is drawn into the motor air intake 1210, travels over the motor (cooling it), and is then exhausted via motor air exhaust 1220.

Figure 12C:
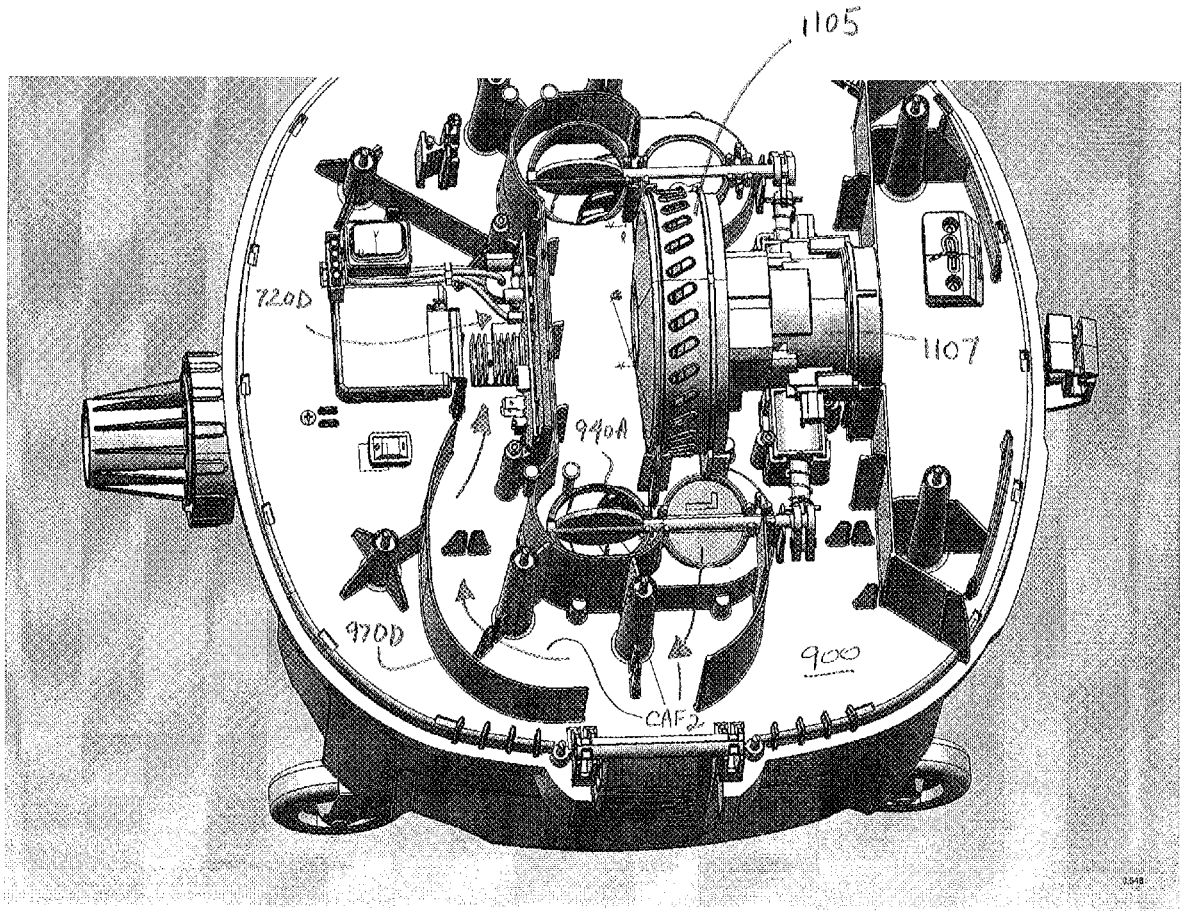

FIG. 12C shows a top perspective view of separation plate 900 including a baffle 970D for directing air from discharge of the fan 1105 to electronics 720D for cooling of the electronics. FIG. 12C illustrates cooling air flow arrows CAF2 showing the path which air takes on its way to dashboard 720D.

Figure 13A:
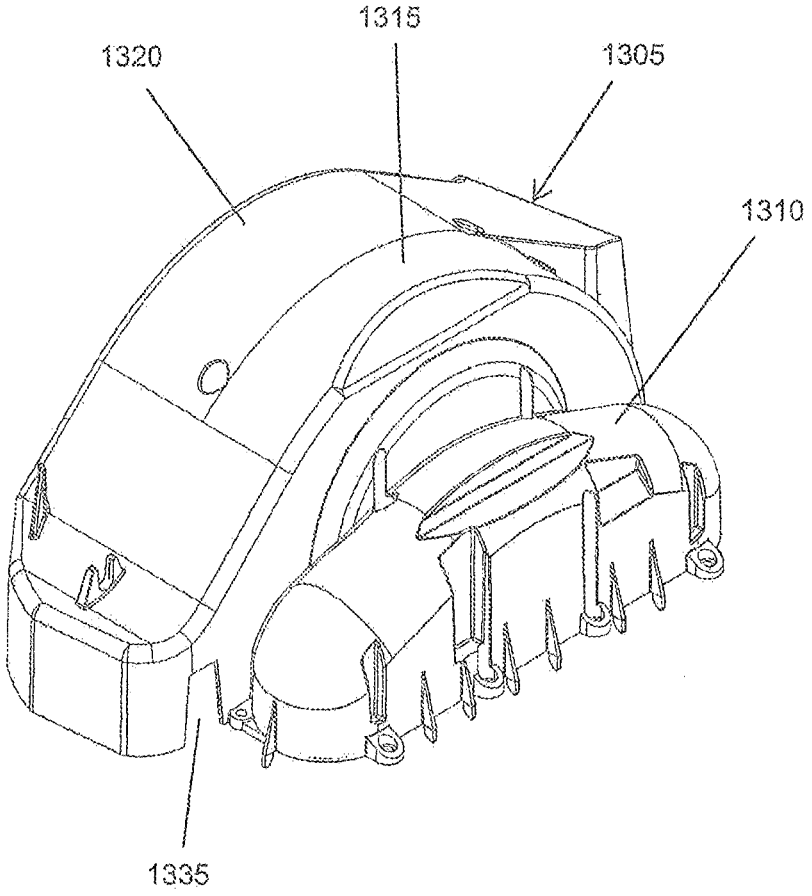
FIG. 13A illustrates a front perspective view of a manifold in accordance with an embodiment of the invention, shown in isolation.
Figure 13B:
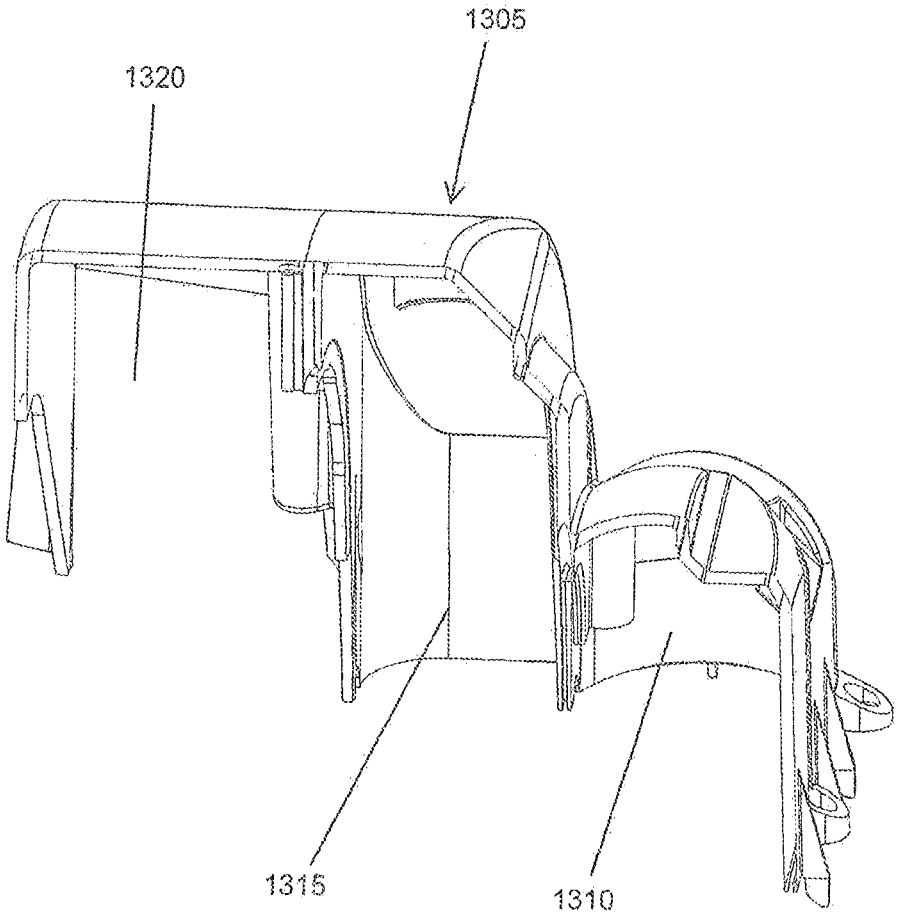
FIG. 13B illustrates a cross sectional view of the manifold shown in FIG. 13A.
Figure 13C:
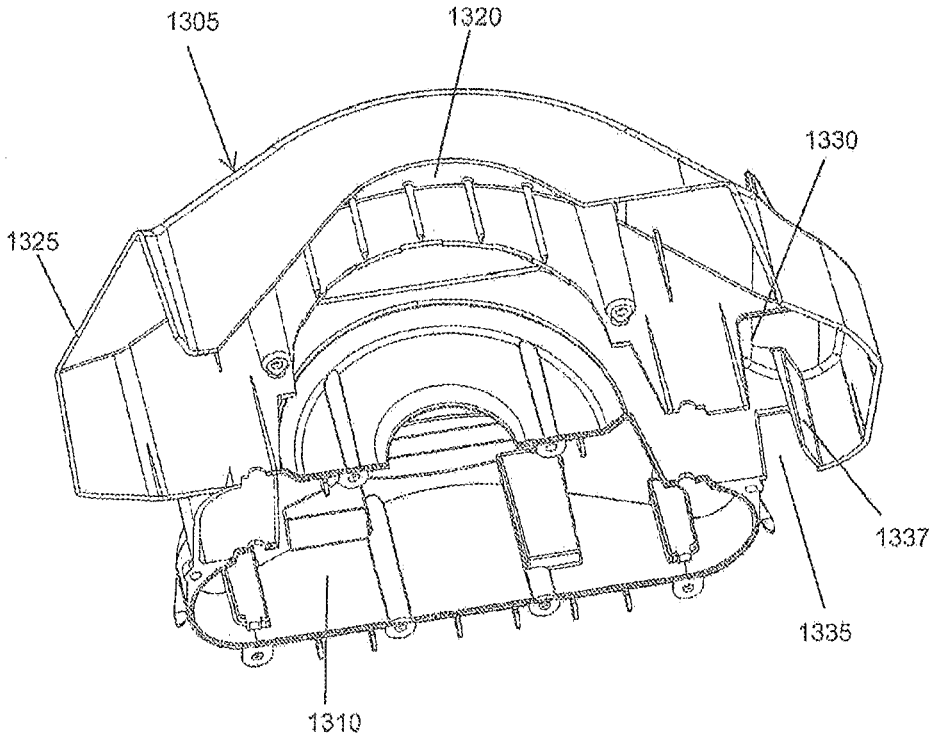
FIG. 13C illustrates a bottom perspective view of the manifold shown in FIG. 13A.

The airflow assembly further includes a manifold operable to direct the airflow in predetermined directions. The manifold includes a plurality of chambers that function as baffles, cooperating to direct airflow in predetermined directions. Referring to FIGS. 13A-13C, the manifold 1305 includes a forward inlet chamber 1310, an intermediate fan discharge chamber 1315, and a rearward exhaust chamber 1320. The exhaust chamber 1320 includes an exhaust port 1325 to permit exhaust of the filtered air from the manifold 1305. In addition, the fan discharge chamber 1315 includes a first window or opening 1330 configured to permit the flow of fluid between the fan discharge chamber 1315 and the exhaust chamber 1320. Additionally, the fan discharge chamber 1315 includes a second window or opening 1335 including an interior deflector 1337 extending angularly inward into the fan discharge chamber such that it directs a portion of the air flowing downstream, through the manifold out of the manifold and into the cavity defined by the head 110.

In another embodiment, manifold 1305 includes a forward inlet chamber 1310D. Adjacent to forward inlet chamber 1310D is a fan discharge chamber 1315D. A blower baffle 1316D is disposed in fan discharge chamber 1315D. A portion of fan discharge air 1306D is directed toward motor 1107 by blower baffle 1316D and passes over motor 1107. At times during vacuum operation, discharge air 1306D is at a lower temperature than motor 1107 and serves to cool motor 1107 as it passes over motor 1107.

In an alternate embodiment, like with the prior described vacuum, the vacuum includes a forward inlet chamber 1310 for defining an airflow passage between suction ports 935A, 940A and the fan intake. In the alternate embodiment however, air passing through the fan discharge chamber 1315D can be redirected to flow over the exterior of motor 1107 before it is discharged into the vacuum head 110. At times during vacuum operation, discharge air 1306D is at a lower temperature than motor 1107 and serves to cool motor 1107 as it passes over motor 1107. Air discharged from discharge chamber 1315 may also be diverted toward vacuum electronics to cool such electronics. After contacting and cooling the motor, the electronics, and any other components it contacts, the air is discharged from the vacuum through openings in vacuum head 110.

Figure 13D:
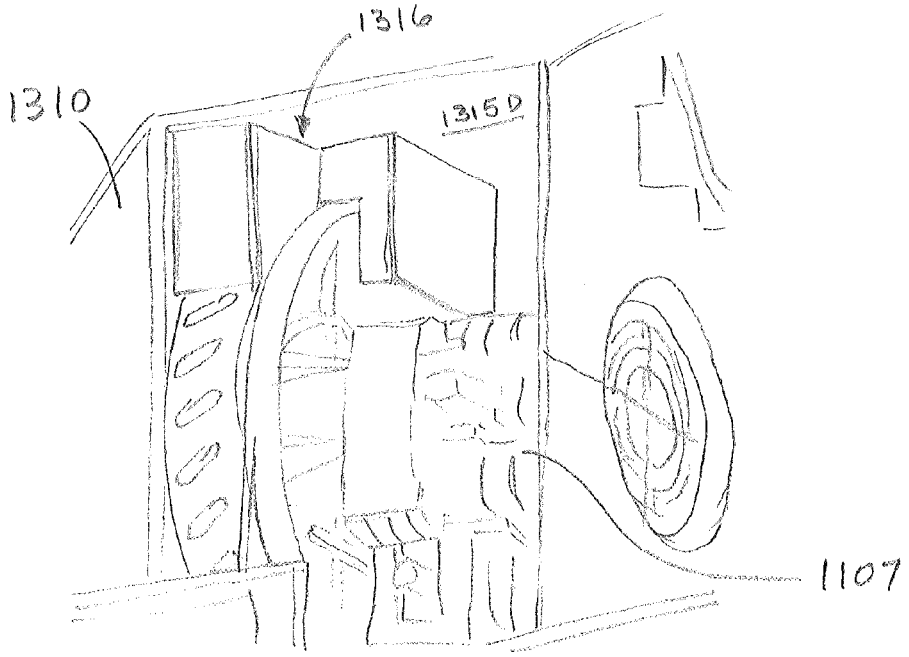
FIG. 13D illustrates a perspective cross-sectional view through manifold of FIG. 13A.
Figure 13E:
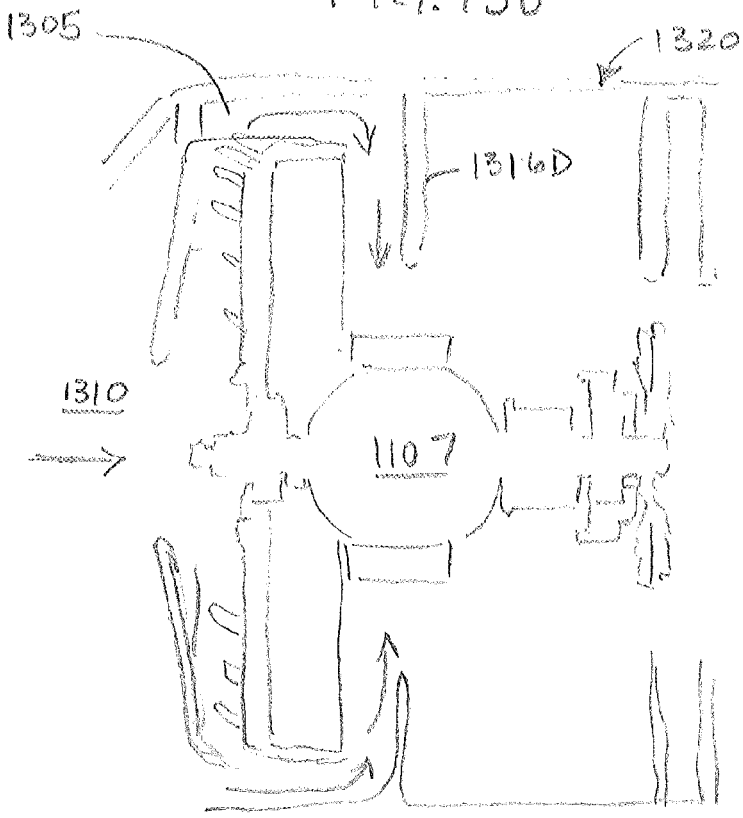
FIG. 13E illustrates a side cross-sectional view through the manifold of FIG. 13A.
Figure 13E:
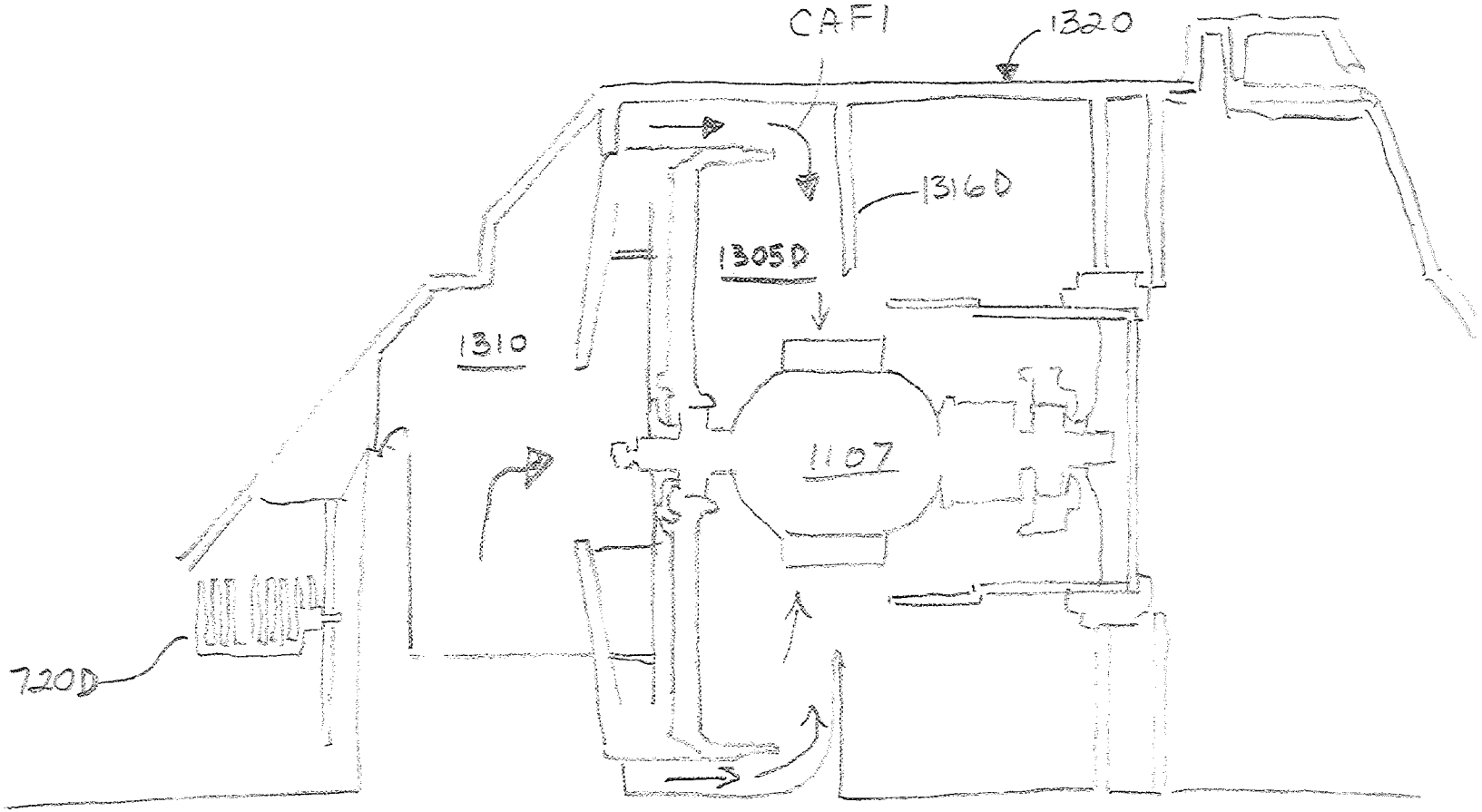

FIGS. 13D-F show blower baffle 1316D disposed in fan discharge chamber 1315D. Baffle 1316D serves as an air diversion baffle or structure for directing at least a portion of the discharge air from the fan discharge 1105 toward and onto motor 1107. FIG. 13F illustrates cooling air flow arrows CAF1 showing the path which motor 1107 cooling air takes between the fan discharge and motor 1107.

Figure 14A:
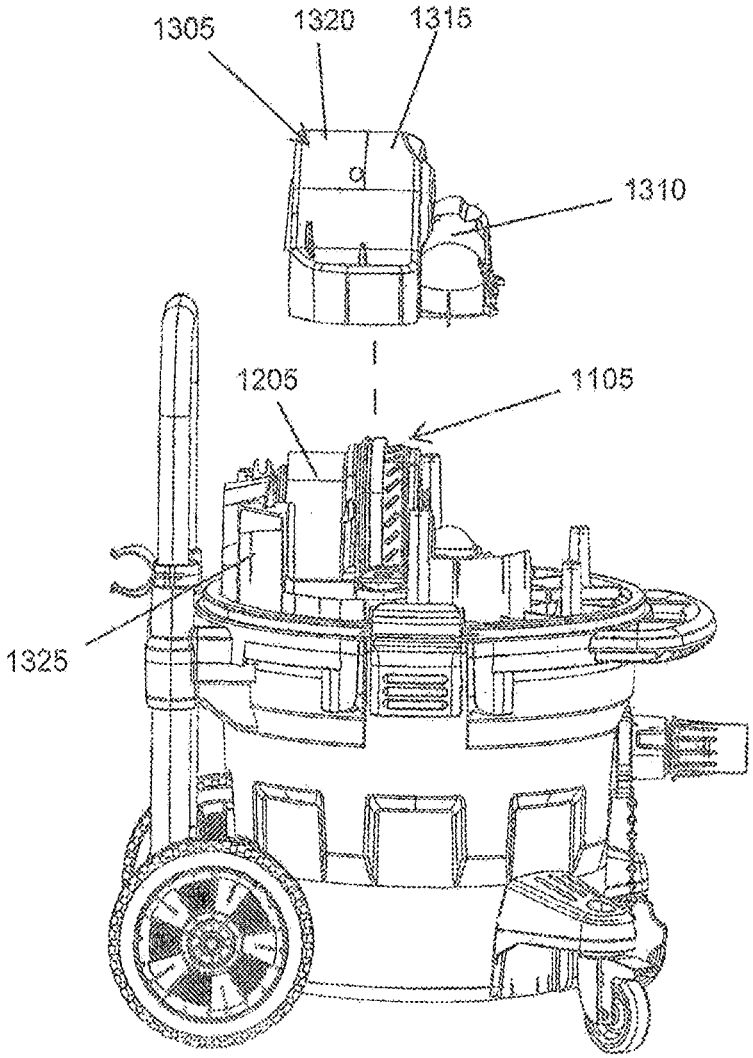
FIG. 14A illustrates an exploded view of the tank and the manifold of the vacuum system, showing the positional relationship between the manifold and the separator plate of FIG. 9A.
Figure 14B:
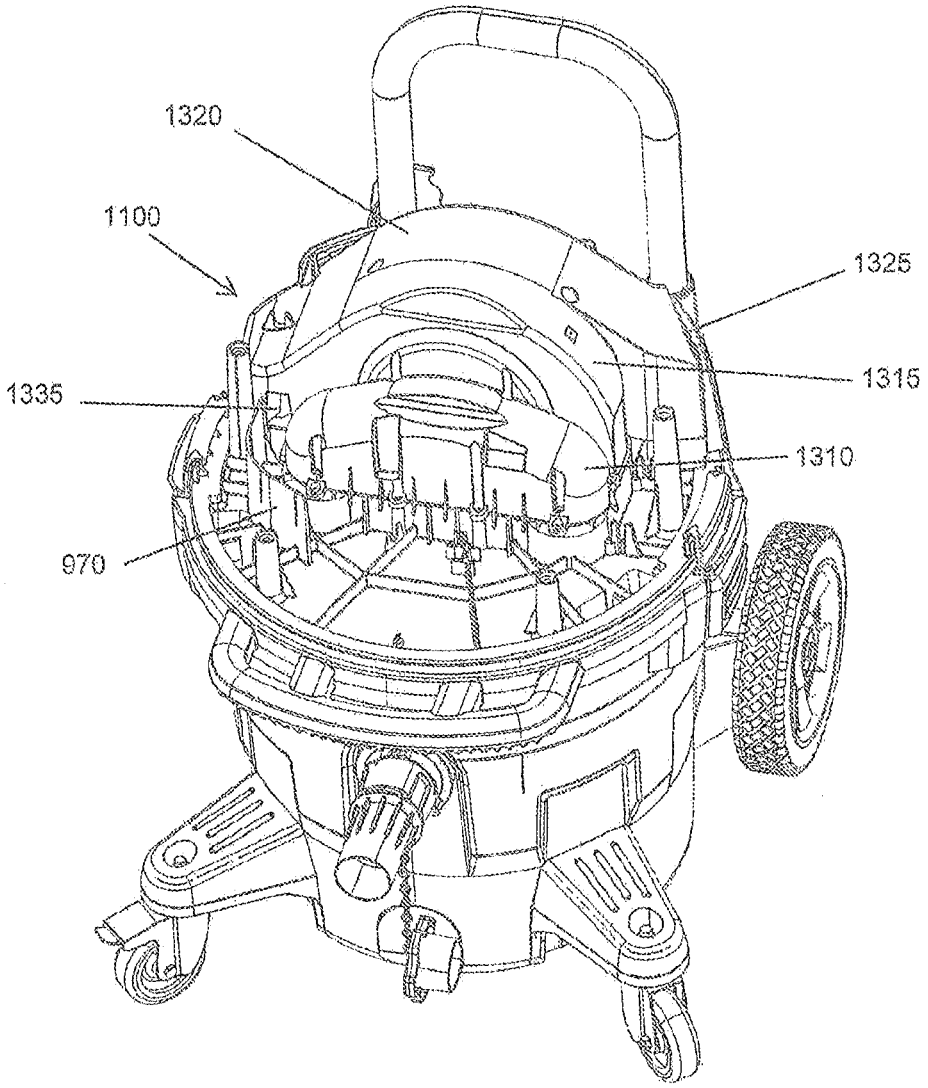
FIGS. 14B and 14C illustrate perspective views of vacuum system with the vacuum head removed for clarity, showing the manifold of FIG. 13A mounted on the separator plate of FIG. 9A.
Figure 14C:
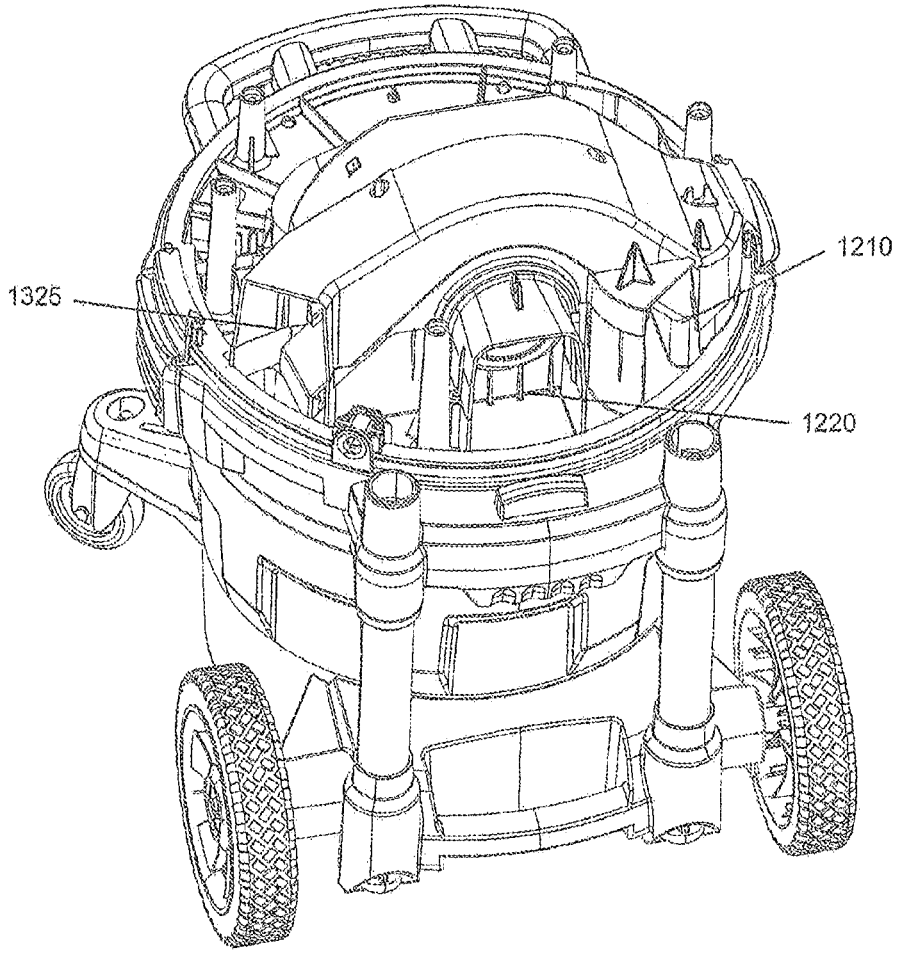

Referring to FIGS. 14A-14C, once coupled to the separation plate 900, the inlet chamber 1310 is positioned over the suction conduits 935A, 940A, the discharge chamber 1315 is positioned over the fan 1105 and the cleaning conduits 935B, 940B, and the exhaust chamber 1320 is positioned over the motor shroud 1205. The operation of the manifold 1305 is discussed in greater detail below.

Figure 15B:
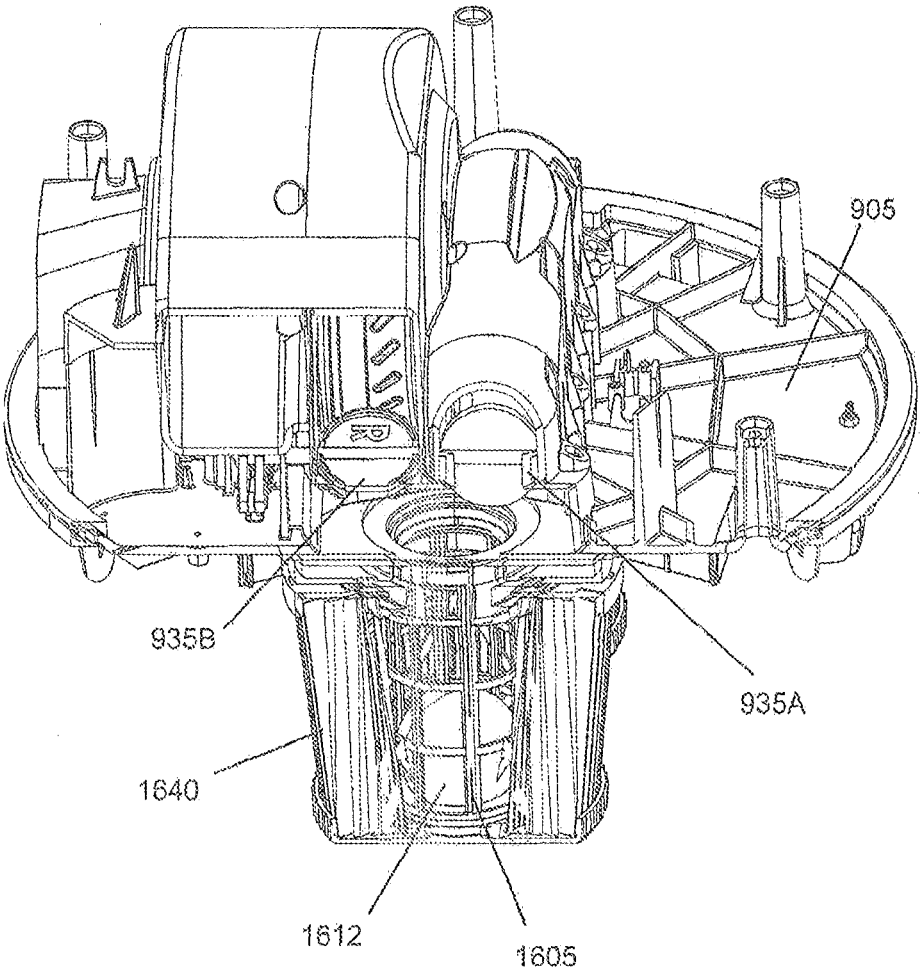
FIG. 15B illustrates a cross sectional view of the filter assembly shown in FIG. 15A.

The vacuum device 10 includes a filter assembly that captures particles within the contaminated airstream entering the tank 105, cleaning the airstream as the airstream flows through the body 100 of the vacuum device 10. In the embodiment illustrated in FIGS. 15A and 15B, the filter assembly 1500 includes a first filter 1505A and a second filter 1505B. The filters 1505A, 1505B may be coupled to the platform lower surface 912, being generally radially aligned along opposite sides of plate center point and suspended above the floor of the tank 105. Additionally, as best seen in FIG. 15B, each filter 1505A, 1505B is in communication with both conduits 935A, 935B, 940A, 940B forming a conduit pair 935, 940 (i.e., the first filter 1505A is in fluid communication with the first conduit pair 935, while second filter 1505B is in fluid communication with second conduit pair 940).

Figure 16A:
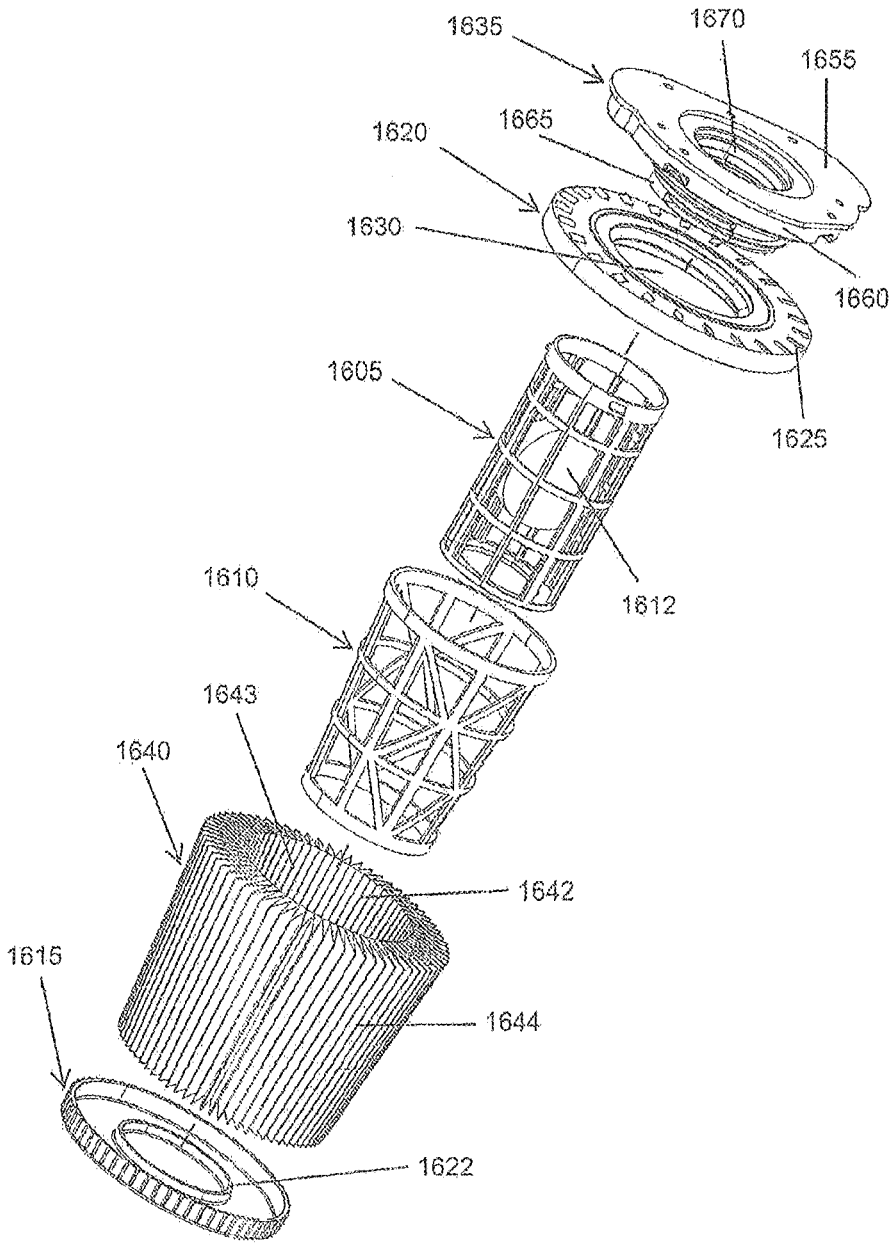
FIG. 16A illustrates an exploded view of a filter device in accordance with an embodiment of the invention.
Figure 16B:
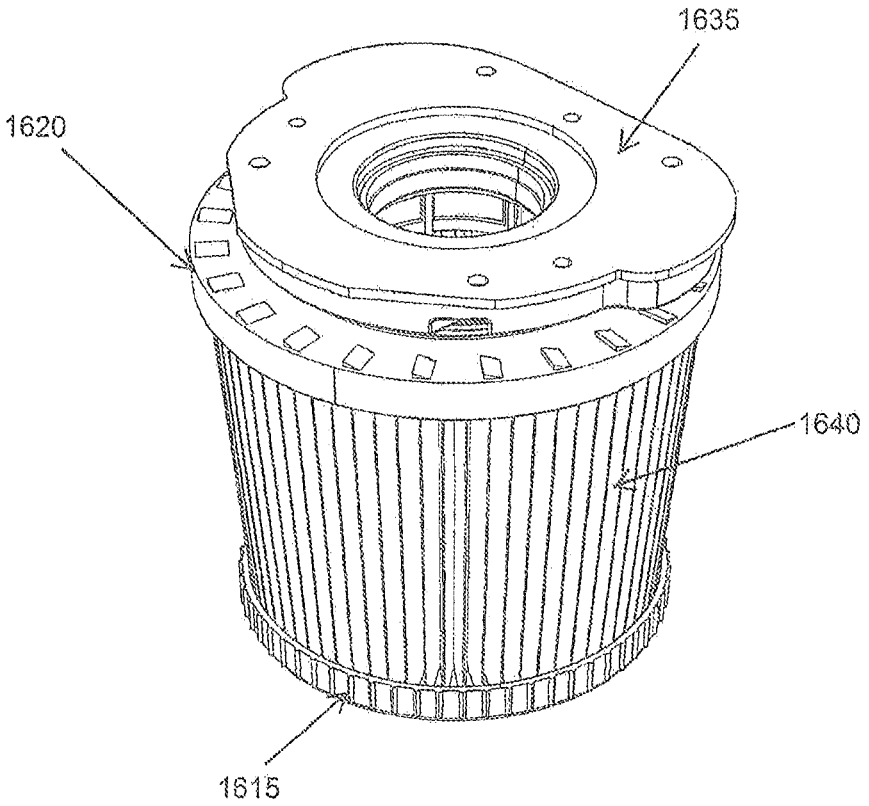
FIG. 16B illustrates a perspective view of the filter device shown in FIG. 16A.

Referring to embodiment illustrated in FIGS. 16A and 16B, each filter 1505A, 1505B may include a substantially rigid, inner cage 1605 generally concentrically disposed within a core member or outer cage 1610. The inner cage 1605, which houses a ball float 1612, may be generally cylindrical. The outer cage 1610, which formed of wire screen, may possess a generally frustoconical shape. The outer cage is generally rigid, providing stiffness from end to end such that it can be threadingly tightened along one of the ends to an end cap. Specifically, the lower (narrower) terminus of the outer cage 1610 couples to a lower end cap 1615, while the upper (wider) terminus of the outer cage couples to an upper end cap 1620. The lower end cap 1615 may be in form of a solid, circular plate with an exterior wall extending upward from the plate and extending about its periphery, as well as an inner wall or rib 1622 concentric with the outer wall and configured to engage the core member 1610 lower end. The upper end cap 1620 may be generally annular, including a plurality of ratchet teeth 1625 disposed along on its upper side (being angularly spaced about the perimeter of the cap). The inner channel 1630 of the upper end cap 1620, moreover, is threaded to mate with corresponding threads on a filter mount 1635 (discussed in greater detail below).

A filter medium 1640 operable to remove particulates from the airstream is mounted on the outer cage 1610. As shown, the filter medium 1640 may in the form of a sleeve including a hollow channel 1642 defined by the interior surface of a wall 1643 and a plurality of longitudinal fins 1644 angularly spaced about the exterior surface of the wall. The filter medium 1640 may possess a shape and dimensions that enable it to contour to the exterior surface of the outer cage 1610 (e.g., the filter may be generally frustoconical). By way of specific example, the filter medium 1640 may possess an upper (wide end) diameter of approximately 6.4 inches, a lower (narrow end diameter) of approximately 5.25 inches, and a length (height) of approximately 5.2 inches. It should be understood that the filter medium 1640 may possess any suitable shape and dimensions, and may be formed of any material an have any structure suitable for its described purpose.

The filter mount 1635, secured to the lower surface 912 of the separator plate 900 (e.g., via fasteners), couples to the upper end cap 1620. The filter mount 1635 includes a seat member 1655 (e.g., a ball seat), a base 1660, and a threaded plug 1665 that engages the threads of the inner channel 1630 of the upper end cap 1620. A channel 1670 is formed into the filter mount 1635 to permit airflow from the filter to its associated conduit pair 935, 940.

Figure 17A:
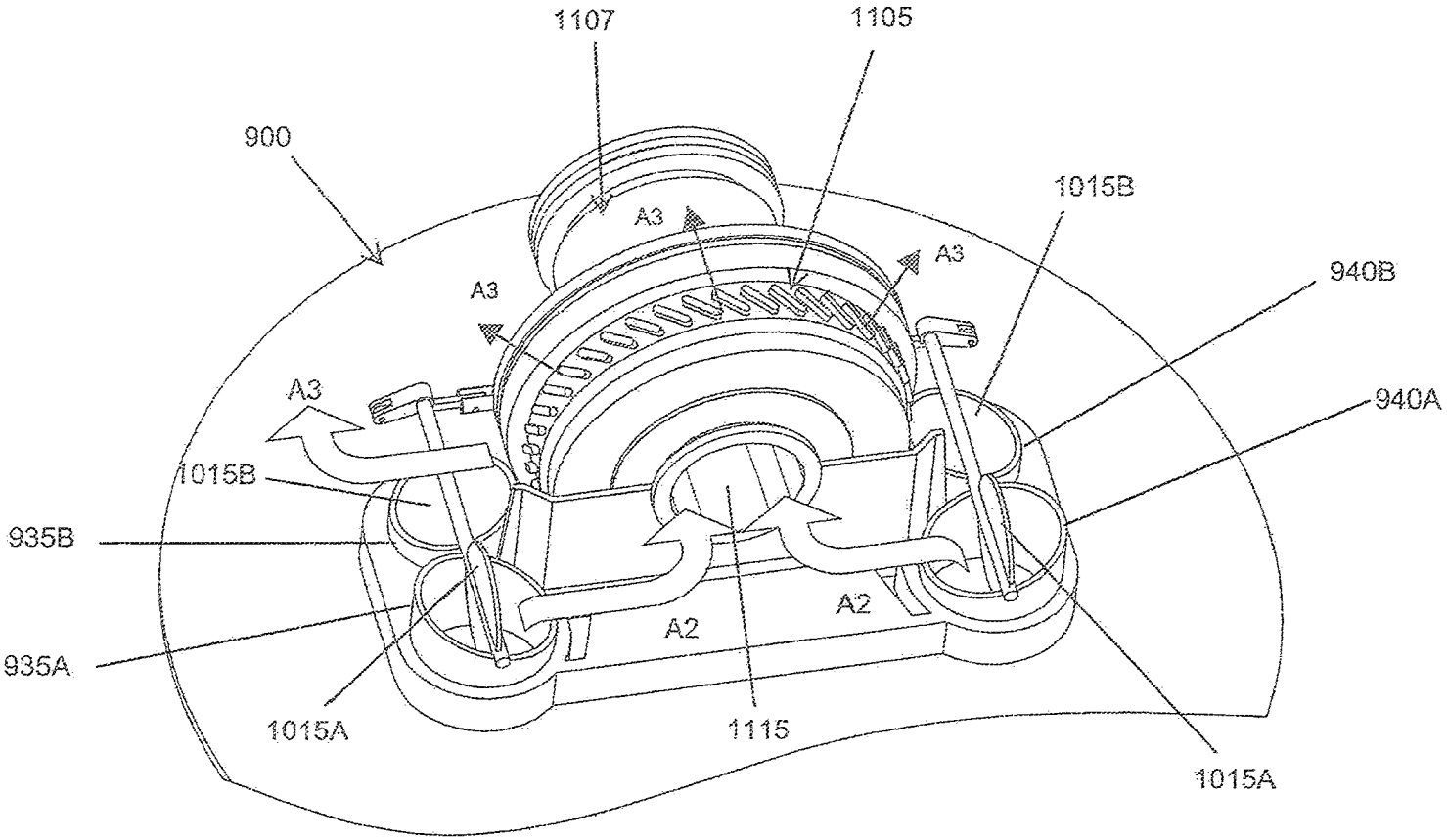
FIGS. 17A-17C illustrate schematic views showing the operation of the airflow assembly.
Figure 17B:
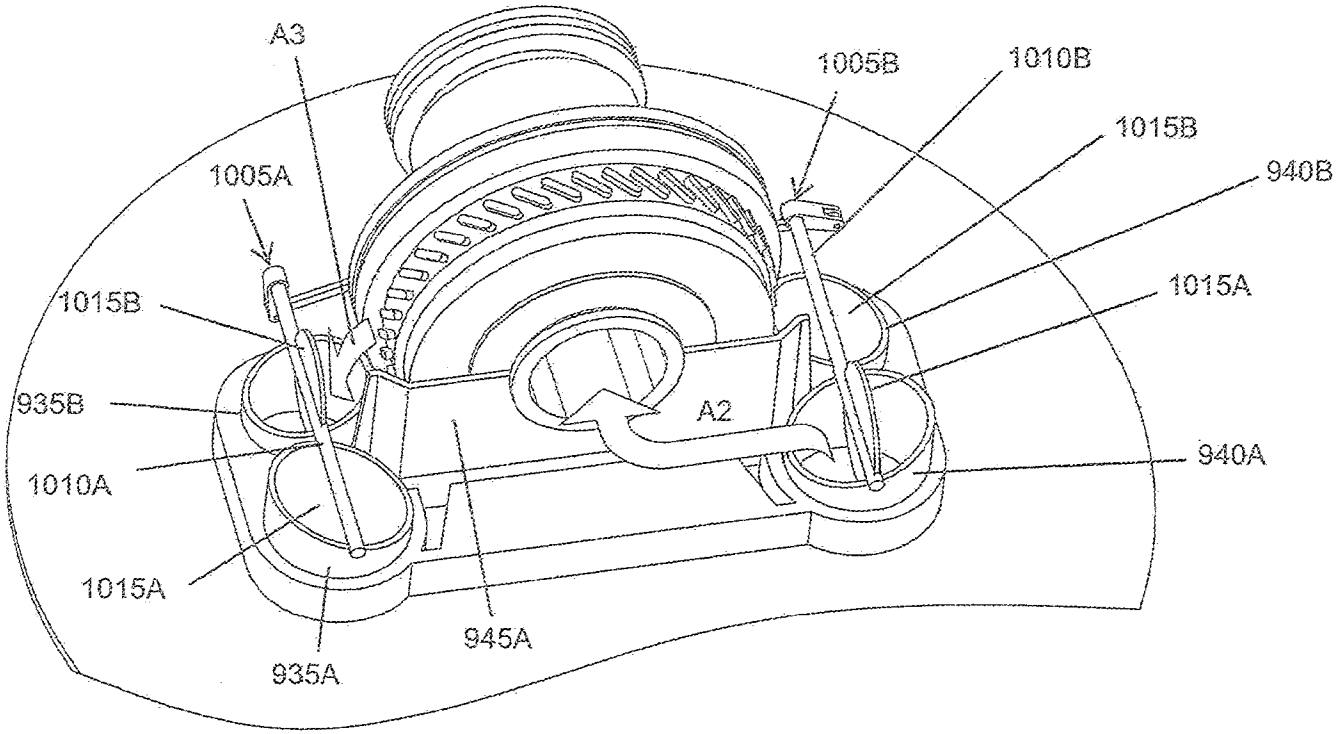
Figure 17C:
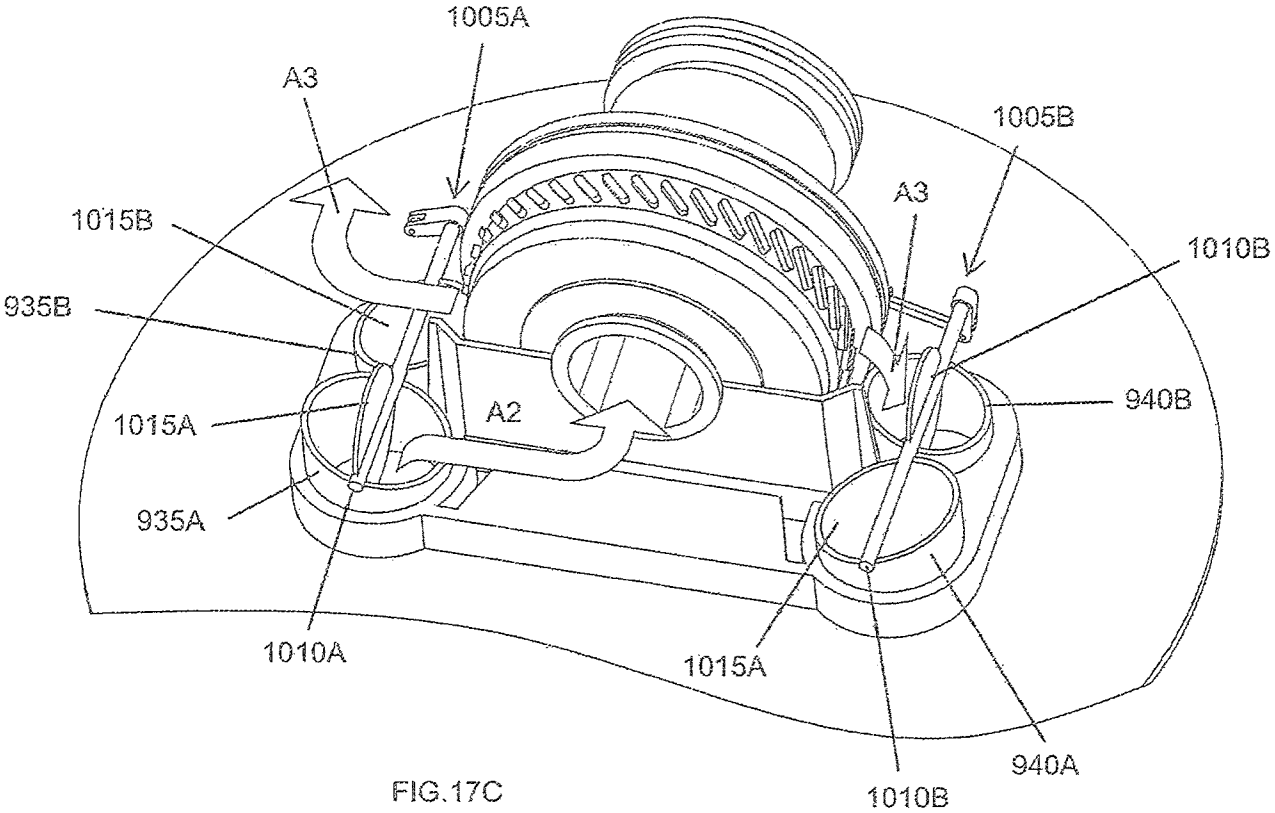
Figure 18A:
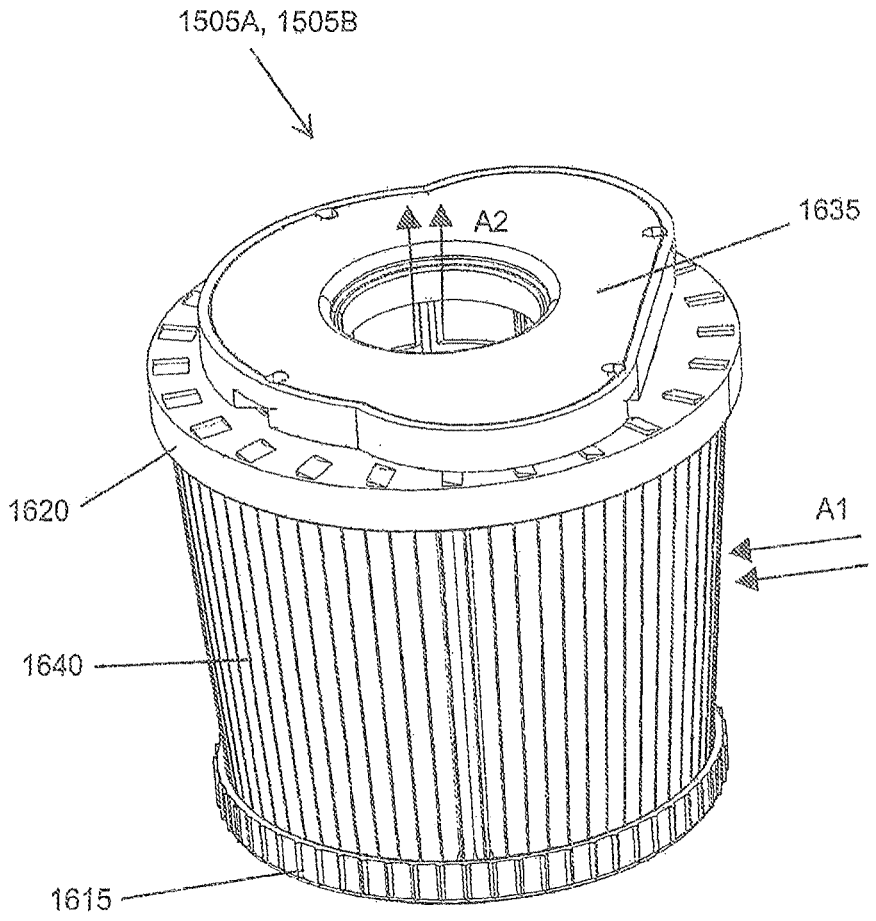
FIGS. 18A and 18B illustrate a schematic views showing airflow through the filter device.

The operation of the vacuum device 10 is explained with references to FIGS. 17A-17C and FIGS. 18A-18C. The motor 1107 is activated (e.g., via controls 725 on dashboard 720), rotating the fan 1105. The fan 1105 creates a vacuum (suction) airflow within the body 100 of the vacuum device 10. Referring to FIGS. 17A and 18A, in a first operational mode, the butterfly values 1005A, 1005B are positioned in their normal, full suction position. In this position, the vacuum device 10 generates suction airflow that is filtered through the filter medium 1640 of each filter 1505A, 1505B. Specifically, the butterfly valves 1005A, 1005B are set such that both the first suction conduit 935A and the second suction conduit 940A are opened, and both the first cleaning conduit 935B and the second cleaning conduit 940B are closed. As a result, the fan 1105 draws contaminated air A1 including debris (particulate material) into the tank 105 (e.g., via an inlet/hose). The contaminated air A1 travels through the collection chamber 214 and is drawn toward the filters 1505A, 1505B. Specifically, the air passes through the filter medium 1640 in a first filter direction, with the air entering the filter medium via the medium exterior surface. As the contaminated air A1 passes through the filter medium 1640 of the filters 1505A, 1505B, particles and other debris within the contaminated air are captured by the filter medium. Larger debris falls (via gravity) to the bottom of the tank 105, while smaller debris becomes attached and/or embedded within the filter medium 1640. This airstream, now filtered air A2, passes upward, through the central channel of the filter (as defined by inner cage 1605) and toward the suction conduit 935A, 940A.

The filtered air A2 passes through the suction conduit 935A, 940A, i.e., from the collection chamber defined by the tank 105 and into the motor chamber defined by the vacuum head 110. Specifically, the filtered air A2 enters the manifold 1305 of the air assembly disposed within the motor chamber, entering the inlet chamber 1310. The filtered air A2 is drawn into the fan central aperture 1115 and is directed radially outward therefrom as fan exhaust or discharge air A3 (indicated by arrows). The discharge air A3 is directed, via the slots 1112, into the manifold discharge chamber 1315. The cleaner conduits 935B, 940B are closed/sealed; consequently, a portion of the discharge air A3 is directed from the discharge chamber 1315, through the first window 1330, and into the exhaust chamber 1320. Additionally, a portion of the discharge air A3 is deflected by manifold deflector 1337 such that it passes through the second window 1335. As such, a portion of the discharge air A3 exits the manifold 1305 (and the vacuum system 10) as manifold exhaust air A4 via manifold exhaust outlet 1325. Additionally, a portion of the discharge air is recycled as electronics coolant A3', exiting the manifold 1305 and returning to the motor chamber defined by the head 110 to cool electronics housed in the head (discussed in greater detail below).

Figure 18B:
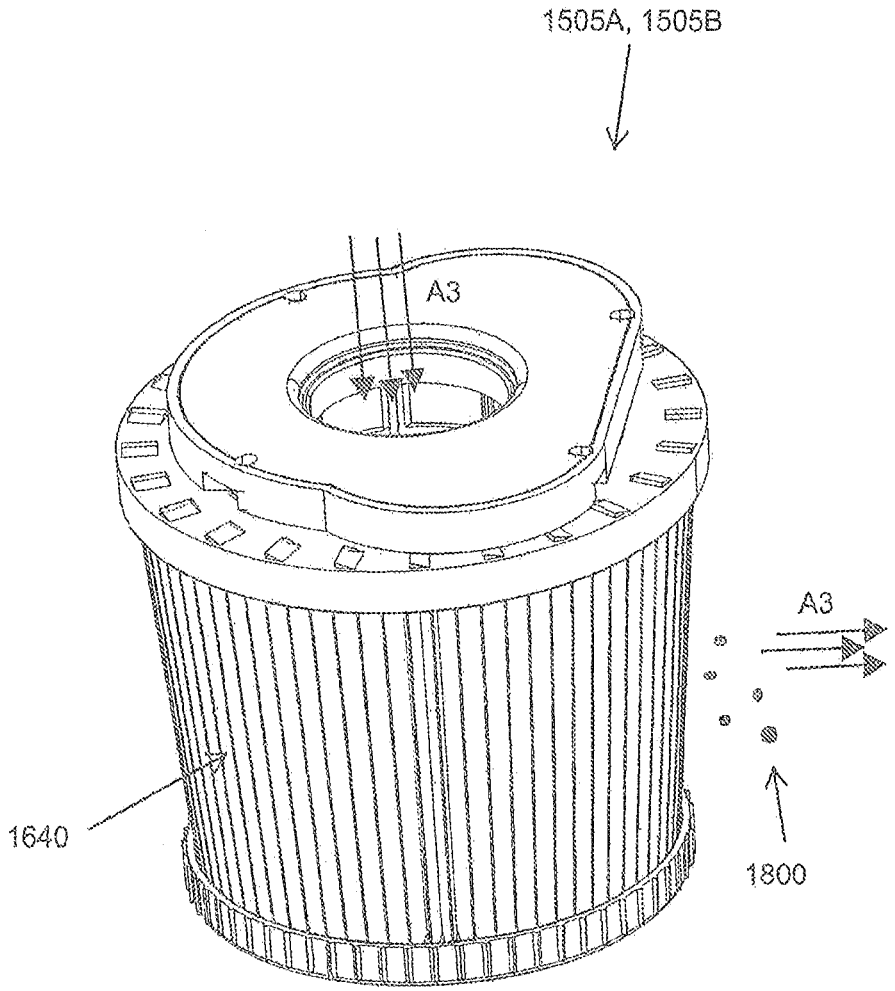

Referring to FIGS. 17B and 18B, in a second operational mode, the filter medium 1640 of the first filter 1505A is purged of debris. In this mode, the first butterfly valve 1005A is engaged to reorient the valve from its normal position to its purge position. Specifically, the first rod 1010A is rotated such that distal disc 1015A covers/seals the first suction conduit 935A and the proximal disc 1015B is positioned such that it is oriented generally transverse to the opening of the first cleaning conduit 935B. In this configuration, the first cleaning conduit 935B is opened, while the first suction conduit 935A is closed/sealed. The second butterfly valve 1005B remains in its normal position as described above, with the second suction conduit 940A being opened and the second cleaning conduit 940B being closed/sealed.

In this configuration, the suction airflow through the first filter 1505A ceases. That is, contaminated air A1 no longer passes through the filter medium 1640 of the first filter 1505A via the filter medium exterior surface. Suction airflow through the second filter 1505B, however, is maintained. The filtered air A2 from the second filter 1505B enters the manifold 1305, where it is drawn into the fan 1105 and expelled through fan slots 1112 as discharge air A3. With the cleaning conduit 935B in its opened position, at least a portion of the discharge air A3 is directed downward, into the first cleaning conduit 935B (indicated by arrow). The discharge air A3 enters the central channel of the first filter 1505A (as defined by the inner cage 1605) and is forced radially outward, passing through the filter medium 1640 in a second filter direction. As shown in FIG. 18B, this outward airflow functions as a purging airflow effective to dislodge at least a portion of the debris and/or particles 1800 previously attached to and/or embedded within the filter medium 1640. Any remaining discharge air A3 (i.e., and discharge air not directed into the cleaning conduit 935B) is directed as indicated above, being expelled from the tank as either manifold exhaust A4 or being recycled as electronics coolant A3'.

In a third operational mode, the filter medium 1640 of the second filter 1505B is purged. The same operation described above with regard to the first filter 1505A occurs with the second filter 1505B. Referring to FIGS. 17C and 18B, the first butterfly valve 1005A is returned to its normal position, in which the first suction conduit 935A is opened and first cleaning conduit 935B is sealed/closed. In addition, the second butterfly valve 1005B is engaged, moving the valve from its normal position to a purge position, in which the second suction conduit 940A is closed and the second cleaning conduit 940B is opened. Similar to that described above, discharge airflow A3 drawn into the manifold 1305 as filtered air is either directed into the second cleaning conduit 940B, out of the head 1010 via the manifold exhaust chamber 1320, or back into the head 1010 via second window 1035. The discharge air A3 that is directed through the cleaning conduit passes through the filter medium 1640 of the second filter 1505B in a second direction (opposite the first direction), thereby purging the filter medium of debris captured thereon.

The amount of time for the purge is not particularly limited. By way of example, the airflow system may operate in the suction mode for a first predetermined period of time and in the purging/cleaning mode for a second predetermined period of time, with the second period of time being less than the first period. In an embodiment, the valve system cycles, generating suction air for approximately 30 seconds, and then generating purge air for approximately 0.3 seconds, alternately purging the first filter 1505A and the second filter 705B. This process continues, with the filters 1505A, 1505B alternately being purged in approximately every 20 seconds.

Figure 19A:
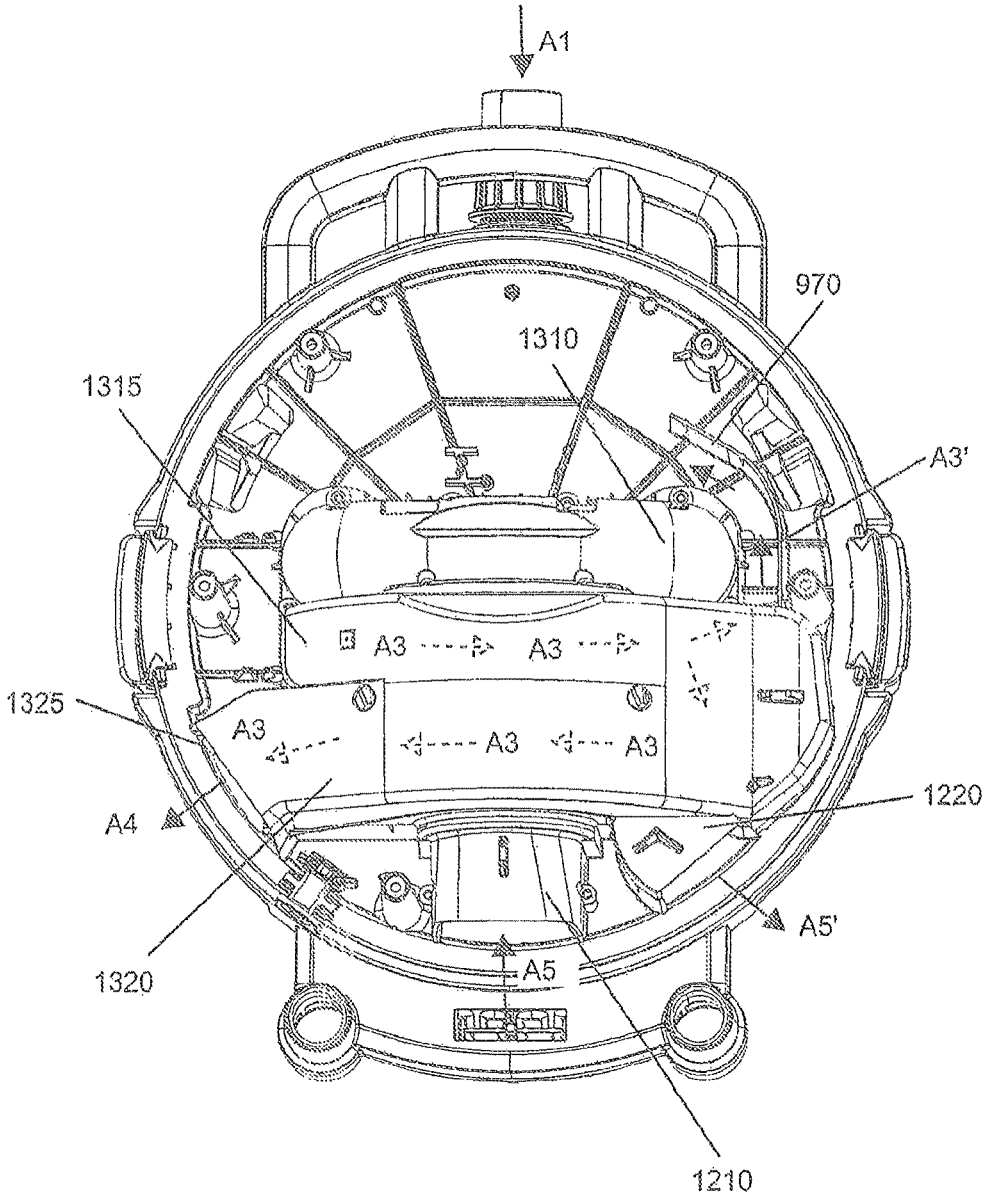
FIGS. 19A and 19B illustrate a schematic views showing airflow through the airflow assembly.
Figure 19B:
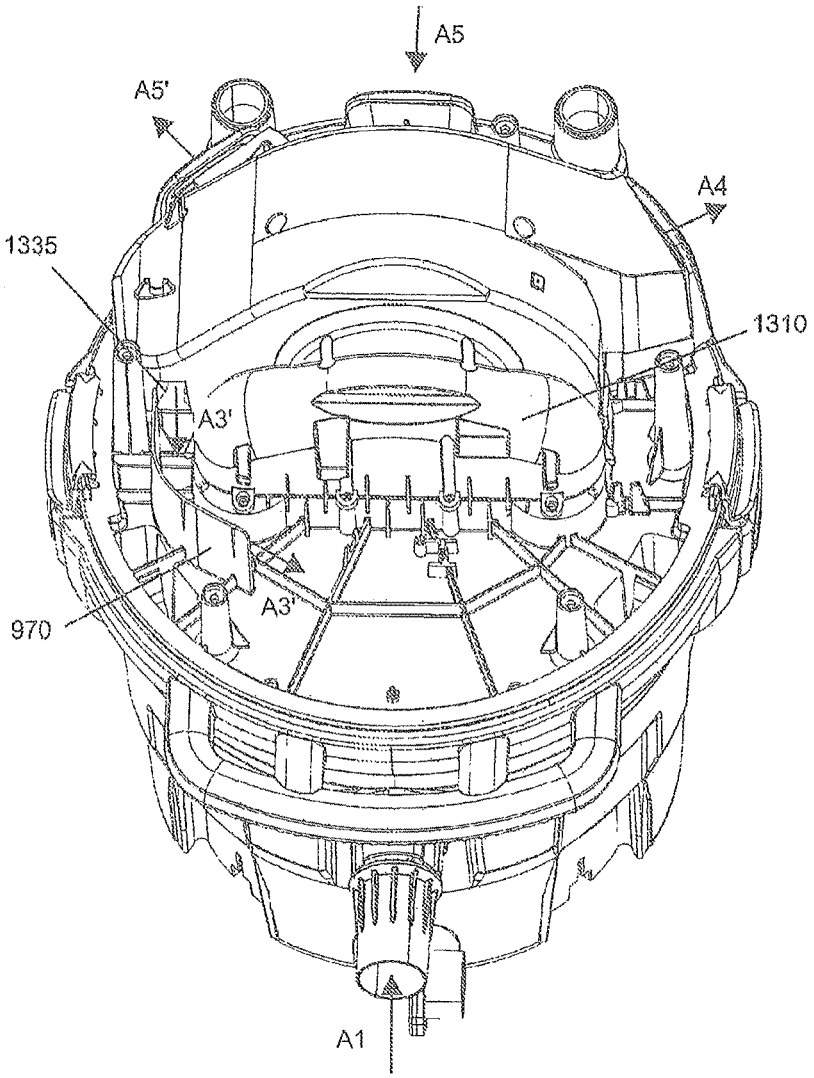

Referring to FIGS. 19A and 19B, during operation, cooling air A5 for the motor 1007 is drawn in through the motor intake port 1210 of the motor shroud 1205, where it is directed across the motor, cooling it, and then out through motor exhaust 1220 as motor exhaust air A5'. As mentioned above, the motor airflow A5, A5' remains separate from the vacuum airflow A1, A2, A3, A3', A4 vacuum filtered air, with the motor shroud preventing the motor air A5, A5' from entering the manifold 1305.

Figure 20:
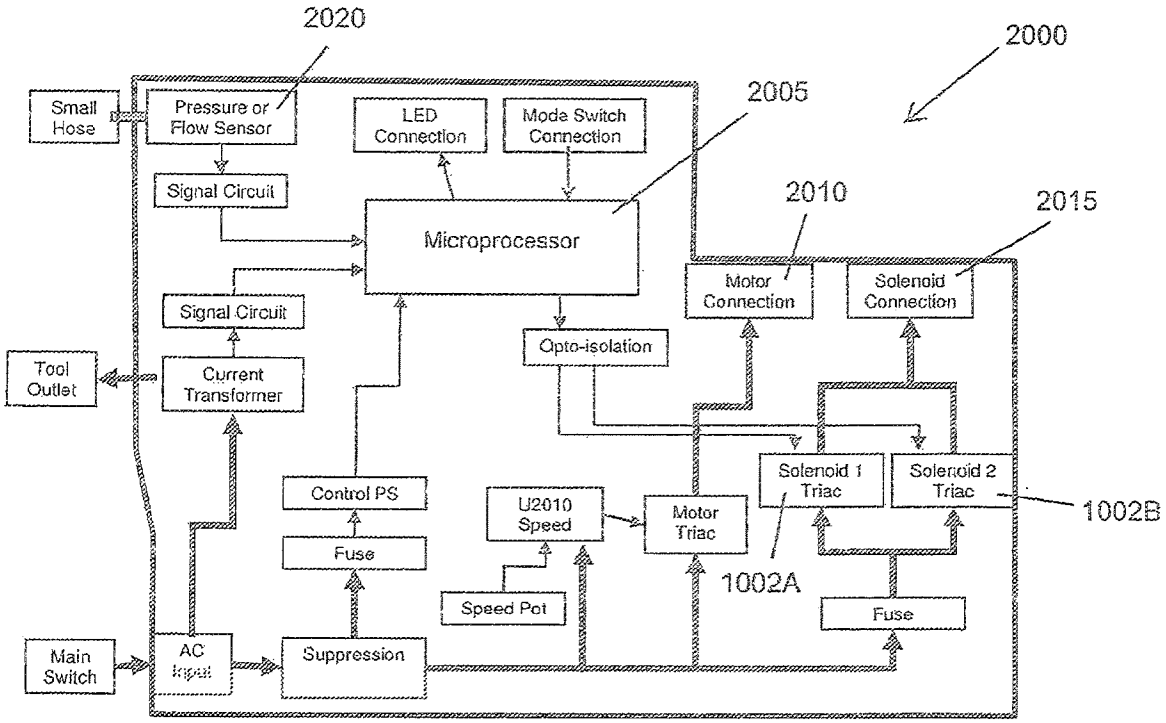
FIG. 20 illustrates an electrical diagram in accordance with an embodiment of the invention.

FIG. 20 illustrates an electrical schematic for the vacuum device 10 in accordance with an embodiment of the invention. As shown, the electrical system 2000 includes a microprocessor 2005 in communication with the motor via motor connect 2010, as well as the butterfly valves 1005, 1005B via a solenoid connect 2015, which, in turn, is in communication with solenoid switches 1002A, 1002B. The system 2000 may further include a pressure or flow sensor 2020 operable to indicate when the intake airflow A1 is reaches (e.g., is above or below) a predetermined threshold value. By way of example, it may indicate when the airflow pressure or flow velocity is below a specified value, thereby notifying the user that the filters must be removed for manual cleaning or replacement.

While the present invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

The invention claimed is:

1. A vacuum device comprising: a tank portion including a collection chamber; a head portion having an airflow assembly including an airflow generating device operable to generate airflow within the vacuum device such that an intake airstream is drawn into the collection chamber via an air inlet and an exhaust airstream is exhausted from the collection chamber via an exhaust outlet; a first filter disposed within the tank collection chamber; a second filter disposed within the tank collection chamber; a separator between the air flow assembly and the tank portion, the separator including; a first passageway through the separator and in fluid communication with the first filter, the first passageway allowing airflow between the collection chamber and airflow generating device, and a second passageway through the separator and in fluid communication with the second filter, the second passageway allowing airflow between the collection chamber and airflow generating device; and the airflow assembly further including, a third passageway in fluid communication with the first filter, the third passageway allowing airflow between the first filter and an air source outside the collection chamber; and a fourth passageway in fluid communication with the second filter, the fourth passageway allowing airflow between the second filter and the air source outside the collection chamber; and a valve assembly operable to selectively and independently permit airflow between at least one of the first filter and the airflow generating device or the outside air source and between the second filter and the airflow generating device or the outside air source; and wherein the valve assembly includes at least two butterfly valves each including a shaft and two offset gates secured to the shaft, the offset gates alternately mating with two respective air passage seats to alternately open one of the first and second passageways while simultaneously closing one of third and fourth passageways.

2. The vacuum device of claim 1, wherein: a rotational axis of the airflow generating device is horizontal in operation.

3. The vacuum device of claim 1, wherein: the airflow generating device comprises a fan rotating about a fan rotational axis; and the fan rotational axis is oriented generally orthogonal to a filter axis.

4. The vacuum device of claim 1, wherein the airflow generating device comprises a centrifugal fan.

5. The vacuum device of claim 1, further comprising a baffle for directing exhaust air from a fan of the airflow generating device onto a motor of the airflow generating device.

6. The vacuum device of claim 1, wherein a light source is pivotably mounted on the head.

7. The vacuum device of claim 1, wherein a flexible member is secure at one end the vacuum and a hook is secured to another end of the flexible member, the flexible member configured to be drawn around an accessory to secure the accessory to the vacuum via the connection of the hook to the rim.

* * * * *